US009124007B2

(12) United States Patent
Yamagajo et al.

(10) Patent No.: US 9,124,007 B2
(45) Date of Patent: Sep. 1, 2015

(54) ANTENNA APPARATUS AND RADIO TERMINAL APPARATUS

(75) Inventors: Takashi Yamagajo, Kawasaki (JP); Yasumitsu Ban, Kawasaki (JP); Shinsuke Shimahashi, Kawasaki (JP); Kouji Soekawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 1046 days.

(21) Appl. No.: 12/961,700

(22) Filed: Dec. 7, 2010

(65) Prior Publication Data

US 2011/0140973 A1 Jun. 16, 2011

(30) Foreign Application Priority Data

Dec. 11, 2009 (JP) ..... 2009-281390

(51) Int. Cl.

| | |
|---|---|
| ***H01Q 1/24*** | (2006.01) |
| ***H01Q 21/28*** | (2006.01) |
| ***H01Q 1/36*** | (2006.01) |
| ***H01Q 1/08*** | (2006.01) |
| ***H01Q 1/22*** | (2006.01) |

(52) U.S. Cl.

CPC ..... *H01Q 21/28* (2013.01); *H01Q 1/084* (2013.01); *H01Q 1/2275* (2013.01); *H01Q 1/36* (2013.01)

(58) Field of Classification Search

CPC ..... H01Q 9/04; H01Q 1/24; H01Q 1/243; H01Q 1/36; H01Q 1/2275; H01Q 1/084; H01Q 21/08

USPC ..... 343/702, 841, 846, 895; 455/575.7

See application file for complete search history.

(56) References Cited

U.S. PATENT DOCUMENTS

| | | | | |
|---|---|---|---|---|
| 5,949,377 | A | 9/1999 | Matsumoto et al. | |
| 6,549,170 | B1 | 4/2003 | Kuo et al. | |
| 7,027,000 | B2 * | 4/2006 | Takagi et al. | 343/702 |
| 7,289,068 | B2 * | 10/2007 | Fujio et al. | 343/700 MS |
| 7,358,906 | B2 * | 4/2008 | Sato et al. | 343/702 |
| 7,411,554 | B2 | 8/2008 | Jung et al. | |
| 7,486,242 | B2 * | 2/2009 | Gala Gala et al. | 343/702 |
| 7,636,065 | B2 | 12/2009 | Ohishi et al. | |
| 7,830,315 | B2 | 11/2010 | Sugiyama et al. | |

FOREIGN PATENT DOCUMENTS

| | | | |
|---|---|---|---|
| JP | 9-148824 | A | 6/1997 |
| JP | 2006-42111 | A | 2/2006 |
| JP | 2007-13643 | A | 1/2007 |
| JP | 2007-243455 | | 9/2007 |
| JP | 2008-29001 | A | 2/2008 |
| JP | 2009-33548 | A | 2/2009 |
| WO | WO-2008/000891 | | 1/2008 |
| WO | WO-2008/131157 | A1 | 10/2008 |

OTHER PUBLICATIONS

Extended European Search Report mailed by EPO and corresponding to European patent application No. 10193635.9 on Mar. 6, 2013.

Japanese Office Action mailed Oct. 22, 2013 for corresponding Japanese Application No. 2009-281390, with Partial English-language Translation.

* cited by examiner

*Primary Examiner* — Michael C Wimer

(74) *Attorney, Agent, or Firm* — Fujitsu Patent Center

(57) ABSTRACT

An antenna apparatus including: a first and second antenna elements which transmit or receive radio signal; a ground pattern; and a wiring pattern which is provided on a line segment connecting the first and second antenna elements, and directly connected to the ground pattern, wherein a circumventing path is formed by the wiring pattern and a part of the ground pattern.

11 Claims, 25 Drawing Sheets

FIG. 4

| | 1.7GHz | 2.0GHz | 2.3GHz |
|---|---|---|---|
| ONE ANTENNA ELEMENT | −1.63 dB | −0.61 dB | −0.74 dB |
| TWO ANTENNA ELEMENTS, WITHOUT STUB | −1.59 dB | −2.59 dB | −2.12 dB |
| TWO ANTENNA ELEMENTS, WITH STUB | −1.07 dB | −1.90 dB | −1.62 dB |

ANTENNA APPARATUS AND RADIO TERMINAL APPARATUS

CROSS-REFERENCE TO RELATED APPLICATIONS

This application is based upon and claims the benefit of priority of the prior Japanese Patent Application No. 2009-281390, filed on Dec. 11, 2009, the entire contents of which are incorporated herein by reference.

FIELD

The embodiments discussed herein are related to an antenna apparatus and radio terminal apparatus.

BACKGROUND

For example, there is a diversity antenna as an antenna apparatus such that same radio signal is received by two antennas, and the signal received from the antenna with superior radio wave condition is preferentially used.

Further, for example, a multimode antenna structure is known in which, by connecting a conductive connection element between two antenna elements, current flowing to feed point of one of two antenna elements is shunted, and the two antenna elements are electrically isolated.

Further, for example, an integrated-type flat-plate multi-elements and electronic equipment are also known in which, by forming a cutout unit in end of a ground pattern, coupling coefficient between two antenna elements can be lowered.

Further, for example, a compact-type portable terminal apparatus for radio reception is also known in which a variable reactance or switch is provided in a concave portion cut out in an edge of an upper grounding conductor, and by the switch or variable reactance, correlation is lowered between antenna elements provided in tip portion of a plurality of convexes on the upper grounding conductor.

Patent Document 1: International Publication Pamphlet No. WO 2008/131157 A1

Patent Document 2: Japanese Laid-open Patent Publication No. 2007-13643

Patent Document 3: Japanese Laid-open Patent Publication No. 2007-243455

However, in the above-described technology of the prior art, when the connection element is directly connected between two antenna elements, characteristic of the antenna element changes. Hence, by further providing a matching circuit in the antenna apparatus, the antenna apparatus can correspond to change of characteristic and can keep reception or transmission frequency within a prescribed range. However, when the matching circuit is further provided in the antenna apparatus, the number of components increases to this extent, and setting space of various elements and similar within the antenna apparatus is reduced. The increase in the number of components or reduction in setting space renders difficult achievement of reduced space or smaller size for the antenna apparatus.

Further, in the above-described technology of the prior art, when the cutout portion is provided in the end of the ground pattern or the concave portion is provided in the upper grounding conductor, if the area of the cutout or concave portion is equal to or greater than a predetermined value, the setting space of various elements or similar set on the ground pattern is reduced by the amount of the cutout or concave portion.

On the other hand, by making the characteristic of the antenna element such as the coupling coefficient, correlation, or similar between antenna elements equal to or greater than a predetermined value, reception characteristic of the antenna apparatus and similar can be improved as well.

SUMMARY

According to an aspect of the invention, an antenna apparatus including: a first and second antenna elements which transmit or receive radio signal; a ground pattern; and a wiring pattern which is provided on a line segment connecting the first and second antenna elements, and directly connected to the ground pattern, wherein a circumventing path is formed by the wiring pattern and a part of the ground pattern.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 illustrates an example of simulation result of antenna efficiency;

DESCRIPTION OF EMBODIMENTS

Embodiments are explained below.

(First Embodiment)

Figure 1:
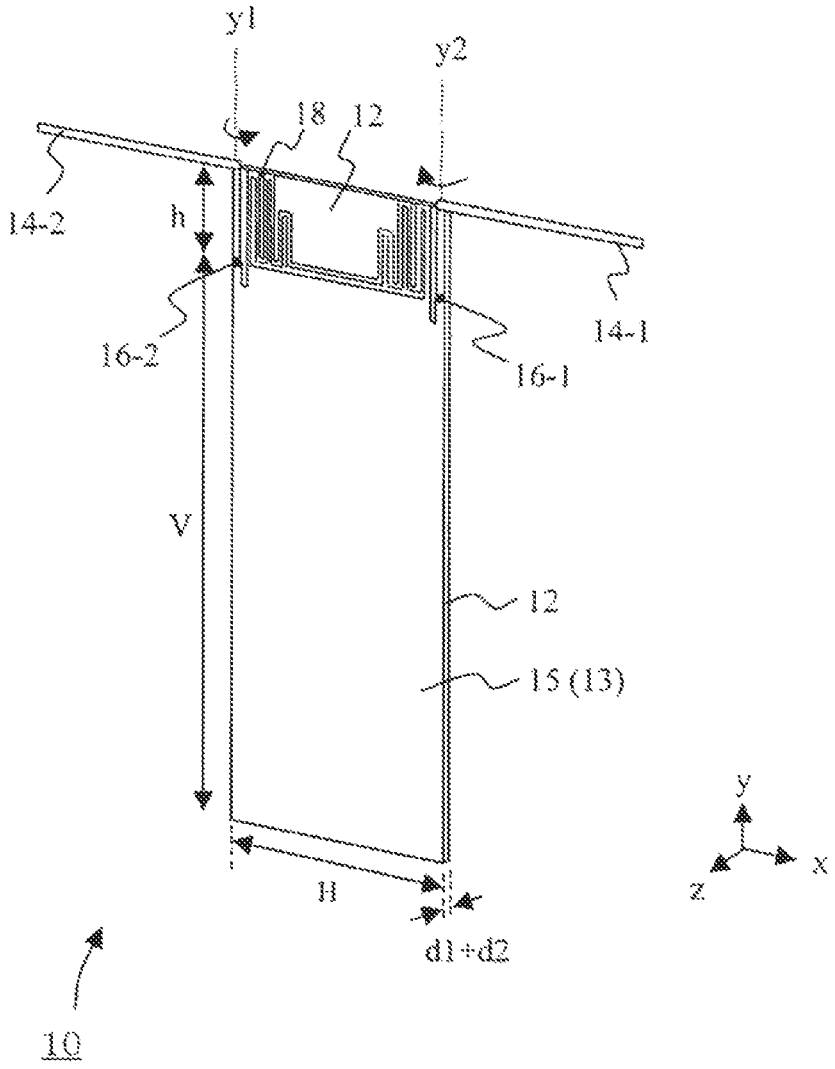
FIG. 1 illustrates a perspective view of an antenna apparatus.
Figure 24A:
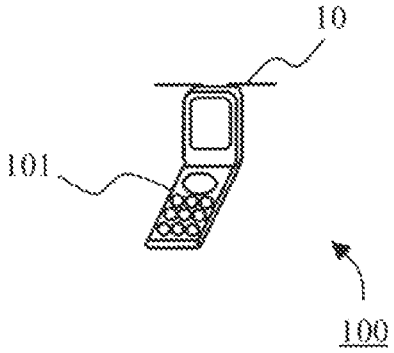
FIG. 24A and FIG. 24B illustrate examples of a radio terminal apparatus.
Figure 24B:
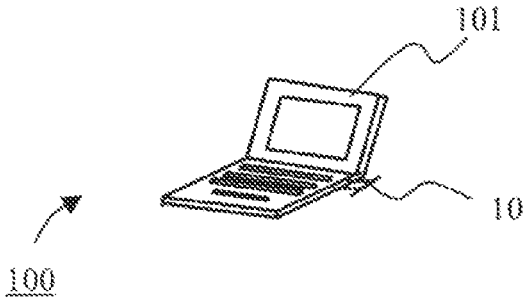

A first embodiment is explained. FIG. 1 illustrates perspective view of an antenna apparatus 10. The antenna apparatus 10 is a card-type antenna apparatus, and can be loaded into or contained within a personal computer, portable telephone, or other radio terminal apparatus, for example. FIG. 24A and FIG. 24B illustrate examples of a radio terminal apparatus 100, FIG. 24A illustrates an example of the portable telephone, and FIG. 24B illustrates an example of the personal computer, as the radio terminal apparatus 100. The antenna apparatus 10 is contained within the housing 101 of the portable telephone 100, and can transmits and receives radio signal to and from a radio base station or similar. Or, the antenna apparatus 10 is loaded into the housing 101 of the personal computer 100, and can transmits and receives radio signal to and from the radio base station or similar.

Figure 2A:
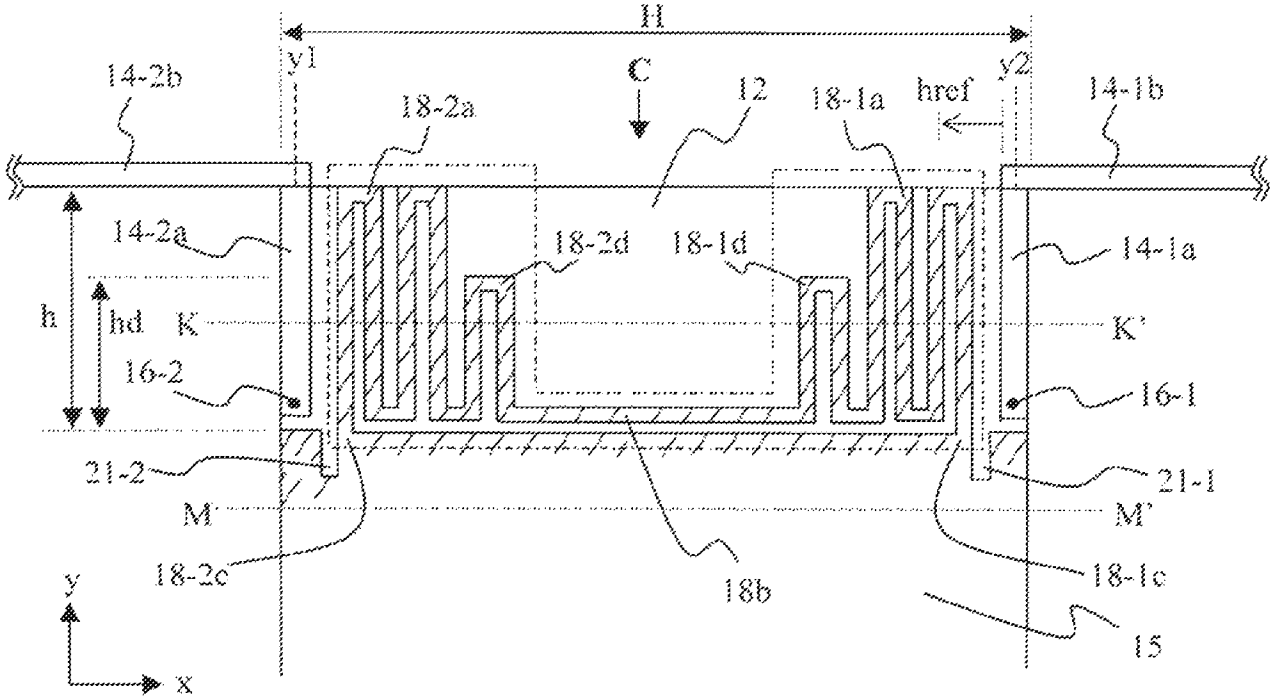
FIG. 2A illustrates an enlarged view of an antenna apparatus.
Figure 2B:
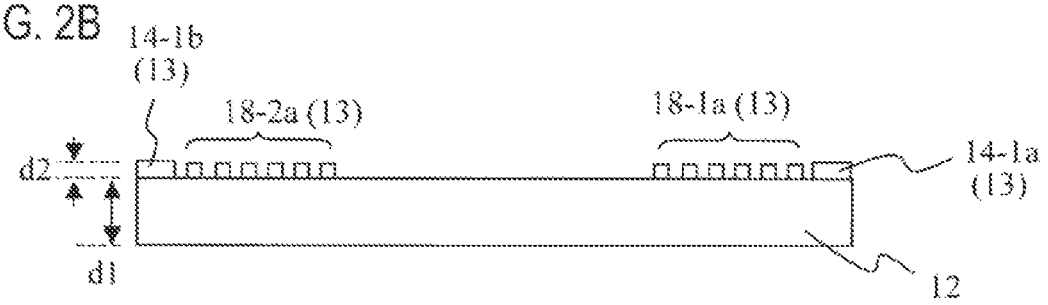
FIG. 2B and FIG. 2C illustrate cross-sectional views of an antenna apparatus.
Figure 2C:
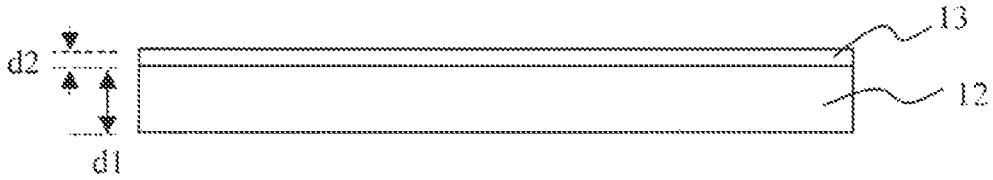

An configuration example of the antenna apparatus 10 is explained. FIG. 1 illustrates a perspective view of the antenna apparatus 10 as described above, and FIG. 2A illustrates a partial enlarged view of the antenna apparatus 10. FIG. 2B illustrates a cross-sectional view of the antenna apparatus 10 from C direction along line segment K-K' in FIG. 2A. FIG. 2C illustrates a cross-sectional view of the antenna apparatus 10 from the C direction along line segment M-M' in FIG. 2A.

As illustrated in FIG. 1, the antenna apparatus 10 includes a dielectric substrate (hereafter "substrate") 12; two antenna elements 14-1 and 14-2 (or, a first antenna element 14-1 and a second antenna element 14-2); and a stub 18.

In the substrate 12, length of y-axis direction is "V+h" (for example, "80 mm"), length of the x-axis direction is "H" (for example, "30 mm"), and length (or thickness) of z-axis direction is "d1+d2" (for example, "1 mm"). A part of top surface of the substrate 12 includes a metal face such as a copper layer 13, for example. Various elements are provided in bottom surface of the substrates 12.

A thickness of the copper layer 13 is d2 (for example "35 μm"), and rectangular portion (V×H) of the copper layer 13 forms a ground pattern 15 to the various elements and similar on the substrate 12.

The antenna elements 14-1 and 14-2 receive radio signal transmitted from another antenna apparatuses, and transmit radio signal to another antenna apparatuses. Each of the antenna elements 14-1 and 14-2 includes fixed units 14-1*a* and 14-2*a* (or a first fixed unit 14-1*a* and a second fixed unit 14-2*a*) fixed on the substrate 12, and bent units 14-1*b* and 14-2*b* bent into L shape from the fixed units 14-1*a* and 14-2*a*.

The bent units 14-1*b* and 14-2*b* can be rotated about y1-axis and y2-axis respectively, and can be contained within width H of the substrate 12 (or antenna apparatus 10). Further, the fixed units 14-1*a* and 14-1*b* includes feed positions 16-1 and 16-2 (or, a first feed position 16-1 and a second feed position 16-2).

The feed positions 16-1 and 16-2 are connected to a part of the element on the substrate 12 via a strip-line, and perform feeding to the antenna elements 14-1 and 14-2.

The stub 18 is a conductive wiring pattern, and is a distributed constant line in a high frequency circuit, for example. As illustrated in FIG. 2A, the stub 18 includes meander units (or meander lines) 18-1*a*, 18-2*a*, 18-1*d*, 18-2*d*, a straight-line unit 18*b*, and connection units 18-1*c* and 18-2*c* (or, a first connection unit 18-1*c* and second connection unit 18-2*c*). Further, the stub 18 is connected to the ground pattern 15 via the connection units 18-1*c* and 18-2*c*.

The stub 18 is constituted of a conductive metal flat plate such as a copper layer 13, similarly to the ground pattern, for example. Further, the thickness of the stub 18 is the same "d2" as the thickness of the ground pattern 15, as illustrated in FIG. 2B and FIG. 2C. Also, the antenna elements 14-1 and 14-2 is constituted of the copper layer 13, the thickness of the antenna elements 14-1 and 14-2 is "d2", for example.

The meander units 18-1*a*, 18-2*a*, 18-1*d*, 18-2*d* are formed such that the copper layer 13 is bent alternately in concave and in convex shape. Between the meander units 18-1*d* and 18-2*d* is connected by the straight-line unit 18*b*. Also, the meander units 18-1*a* and 18-2*a* are provided in proximity to the fixed units 14-1*a* and 14-2*a* of the antenna element 14 (for example, within a threshold value href from the fixed units 14-1*a* and 14-2*a*). As illustrated in FIG. 2A, the length (h) in the long-edge direction of the meander units 18-1*a* and 18-2*a* become shorter on receding from the antenna elements 14-1*a* and 14-1*b* (the length in the long-edge direction of the meander units 18-1*d* and 18-2*d* is hd (<h) relative to the length h in the long-edge direction of the meander units 18-1*a* and 18-2*a*).

As illustrated by dot-dash line in FIG. 2A, a loop (or a circulation path) is formed by the stub 18 and a part of the ground pattern 15. In FIG. 2A, the loop is a path which passes from the first connection unit 18-1*c* via the meander unit 18-1*a* and similar to reach the second connection unit 18-2*c*, and passes through a part of the ground pattern 15 to return to the first connection unit 18-1*c*, for example. When one of the two antenna elements 14-1 and 14-2 is fed, a current equal to or greater than a predetermined current flows in the loop, and the two antenna elements 14-1 and 14-2 obtains a predetermined characteristic or greater. Details are given below.

In following embodiments including the present embodiment, the length of the loop formed by the stub 18 and the part of the ground pattern 15 is substantially the same length as one wavelength of frequency of the radio signal transmitted or received in the antenna apparatus 10. By employing such the configuration, the stub 18 becomes parallel resonance condition at the frequency, and the predetermined current or greater flows in the loop as described above. Details are given below. In the present embodiment and following embodiments, the length of the loop is called an electrical length, for example.

The antenna apparatus 10, as illustrated in FIG. 1 and FIG. 2A, includes slits 21-1 and 21-2 disposed in the part of the ground pattern 15. By the slits 21-1 and 21-2, characteristic such as coupling between the antenna elements 14-1 and 14-2 and similar is improved.

Next, simulation result for the antenna apparatus 10 is explained. The inventor of the present application performs various simulations of the antenna apparatus 10. FIG. 3 to FIG. 11 illustrate simulation result examples and similar.

Figure 3:
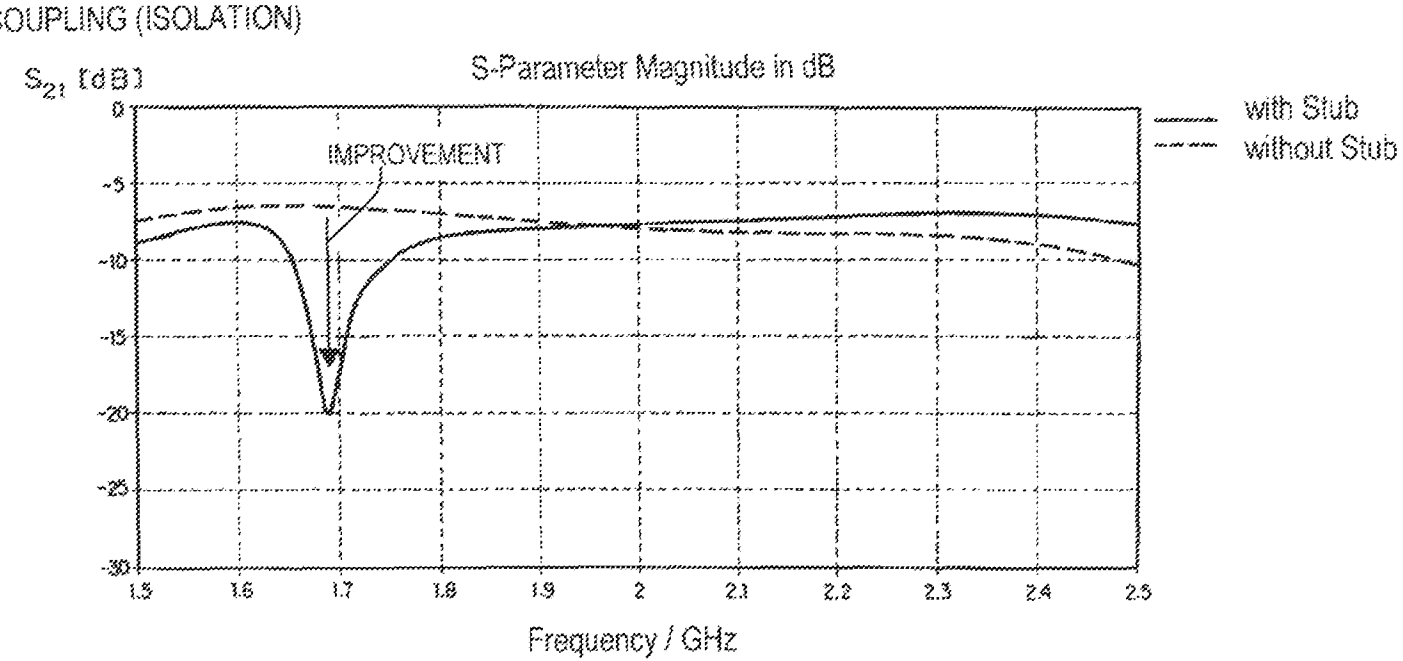
FIG. 3 illustrates an example of simulation result of $S_{21}$.

FIG. 3 illustrates an example of simulation result for $S_{21}$ (or "coupling") of S parameters. In this simulation, to the antenna apparatus 10 illustrated in FIG. 1 or similar, AC voltage is supplied from the first feed position 16-1 to the first antenna element 14-1, and the frequency of the voltage is changed. In such a case, the present simulation simulates $S_{21}$ based on the voltage and voltage output from the second feed position 16-2. A voltage source is assumed to be disposed between the ground pattern 15 and the first feed position 16-1, for example. In FIG. 3, horizontal axis indicates frequency, and vertical axis indicates $S_{21}$ (in decibels). In FIG. 3, broken line indicates the simulation result for the antenna apparatus 10 without the stub 18, and solid line indicates the simulation result for the antenna apparatus 10 with the stub 18.

As illustrated in FIG. 3, when the AC voltage frequency is "1.7 GHz", $S_{21}$ value of the antenna apparatus 10 with the stub 18 is much lower than the antenna apparatus 10 without the stub 18. The simulation result can be obtained indicating that the coupling of the two antenna elements 14-1 and 14-2 of the antenna apparatus 10 with the stub 18 is lower and improved than the antenna apparatus 10 without the stub 18.

FIG. 4 illustrates an example of simulation result for antenna efficiency. The antenna efficiency represents ratio of power applied to each of the antenna elements 14-1 and 14-2 to radiant power, for example. For example, when the AC voltage is applied to the first feed position 16-1 and the frequency of the applied AC voltage is changed, the simulated result indicates an example simulating the power radiated into space in the first antenna element 14-1. Simulation is performed in a case that the "antenna element" is "one", that there are "two antenna elements" and "without stub", and that there are "two antenna elements" and "with stub", with the frequency of the AC voltage changed "1.7 GHz", "2.0 GHz", and "2.3 GHz".

As illustrated in FIG. 4, the simulation result is obtained indicating that the antenna efficiency of the case of "two antenna elements with stub" is lower than the case of "two antenna element without stub" at each frequency. The simulation result is obtained indicating that value of the antenna efficiency of the case of with stub 18 is higher than the case of without stub 18 at each frequency including "1.7 GHz" frequency, therefore, improved simulation result is obtained.

Figure 5B:
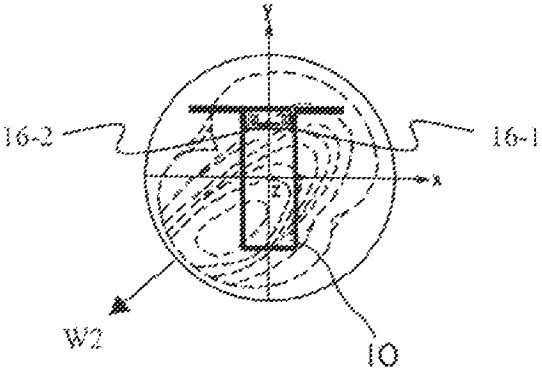
FIG. 5A and FIG. 5B illustrate examples of simulation result of radiation pattern.
Figure 5A:
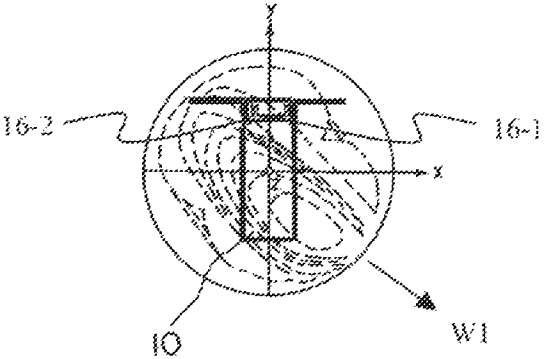
Figure 6:
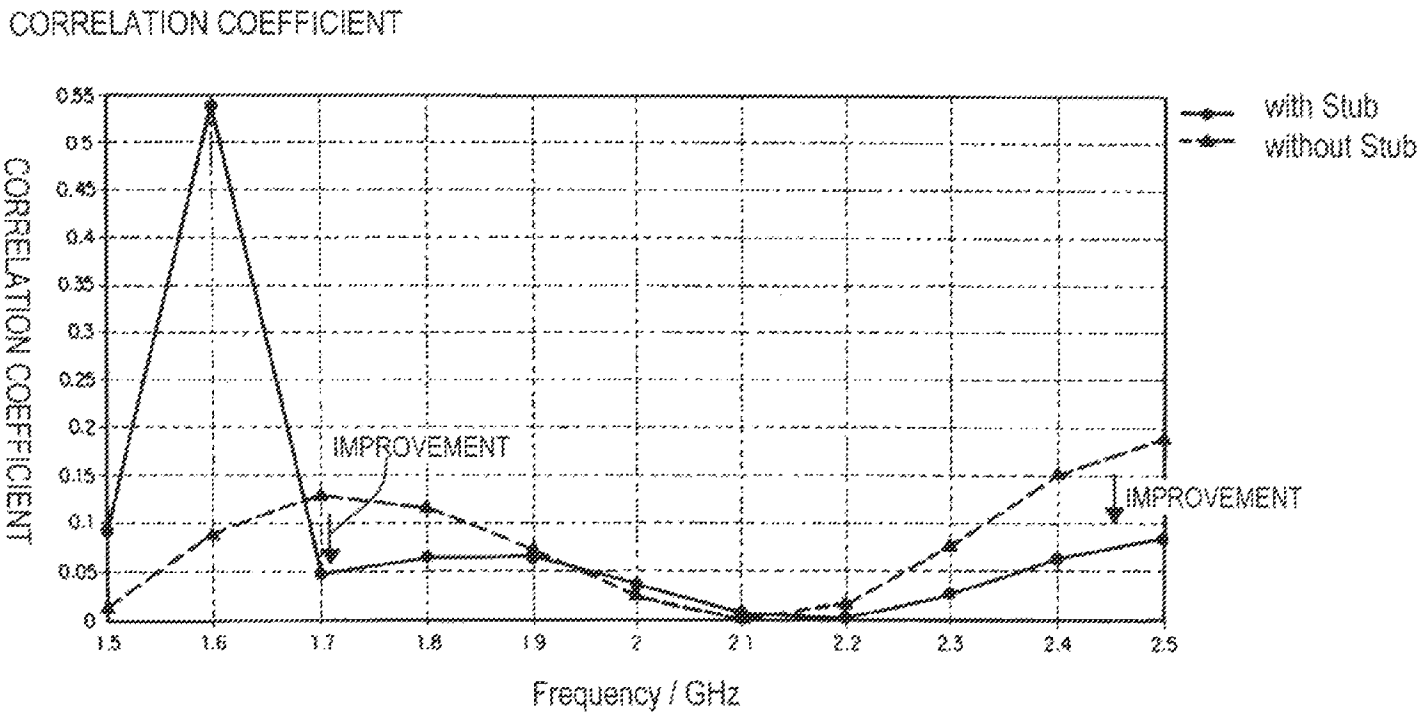
FIG. 6 illustrates an example of simulation result relating to correlation coefficient.

FIG. 5A and FIG. 5B illustrate simulation results of radiation patterns, and FIG. 6 illustrates simulation result of correlation coefficient. The radiation pattern illustrated in FIG. 5A indicates directional distribution when the AC voltage is applied to the first feed position 16-1 of the antenna apparatus 10 at frequency "1.7 GHz", and no voltage is applied to the second feed position 16-2, for example. Further, the radiation pattern illustrated in FIG. 5B illustrates directional distribution when the AC voltage is applied to the second feed position 16-2 at frequency "1.7 GHz", and no voltage is applied to the first feed position 16-1, for example.

When the AC voltage is applied to the first feed position 16-1, power distribution is the highest in first quadrant of x-axis and second quadrant of y-axis, and overall, high power is distributed in direction of the first feed position 16-1 on the feed side (W1 direction), as illustrated in FIG. 5A. On the other hand, when the AC voltage is applied to the second feed position 16-2, the power distribution is the highest in second quadrant of the x-axis and second quadrant of y-axis, and overall, high power is distributed in direction of the second feed position 16-2 on the feed side (W2 direction), as illustrated in FIG. 5B.

In this way, the two radiation patterns are directed in reverse directions (the W1 direction and W2 direction), and so simulation result is obtained indicating that the correlation between the two antenna elements 14-1 and 14-2 is lower than a predetermined case.

FIG. 6 illustrates simulation results of correlation coefficient when the frequency of the applied AC voltage is changed based on the radiation patterns of FIG. 5A and FIG. 5B. The correlation coefficient is also an index indicating to what extent to be identical the radiation pattern on feeding from the first feed position 16-1 (FIG. 5A) and the radiation pattern on feeding from the second feed position 16-2 (FIG. 5B), for example. In FIG. 6, solid line is the simulation result of the case that there is the stub 18, and the broken line is the simulation result of the case that there is without stub 18.

As illustrated in FIG. 6, the correlation coefficient of the antenna apparatus 10 with the stub 18, compared with the case of without stub 18, becomes a low value, from "1.7 GHz" to "1.9 GHz", from "2.3 GHz" to "2.5 GHz". Hence, with respect to correlation coefficient also, improved simulation result is obtained for the antenna apparatus 10 with the stub 18 compared with the antenna apparatus 10 without the stub 18. From these simulation results, the correlation between the two antenna elements 14-1 and 14-2 of the antenna apparatus 10 with the stub 18 is lower than the antenna apparatus 10 without the stub 18.

Figure 7:
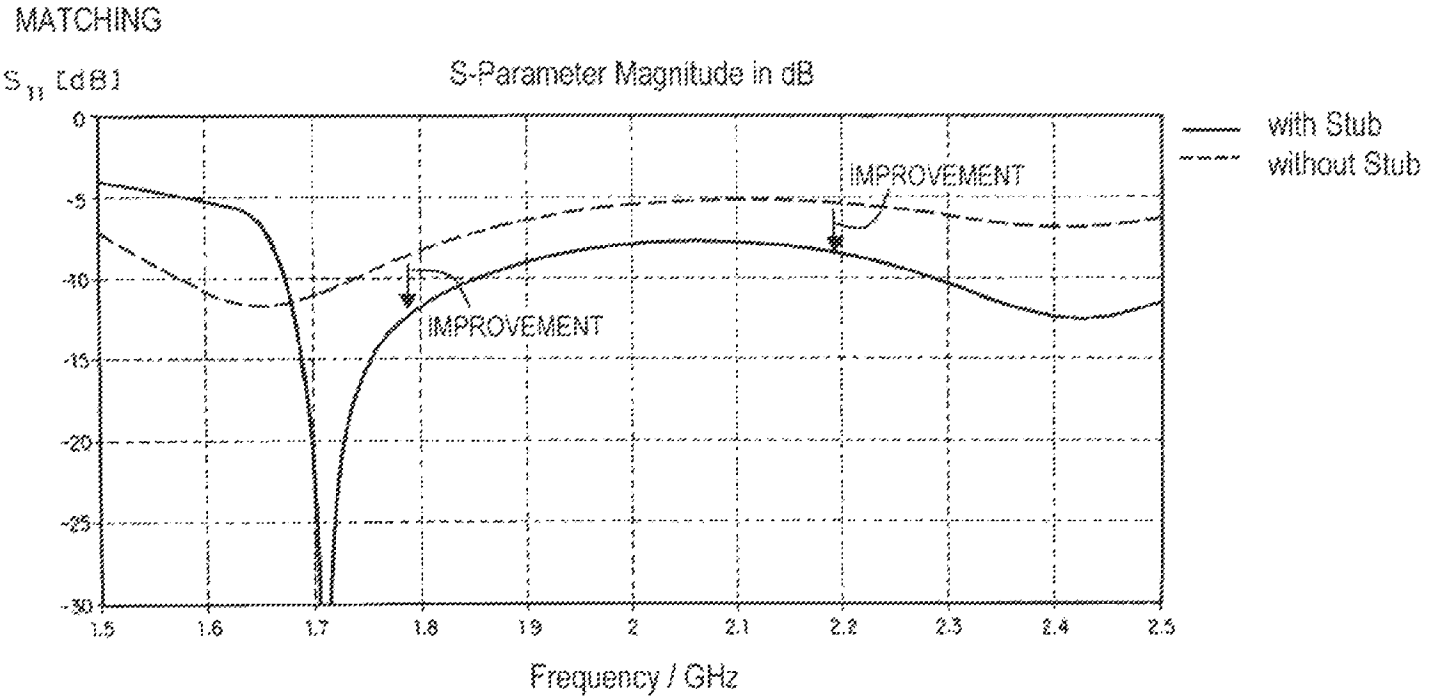
FIG. 7 illustrates an example of simulation result relating to $S_{11}$.

FIG. 7 illustrates simulation result of $S_{11}$ (or "matching") of the S parameters. For example, in the antenna apparatus 10 illustrated in FIG. 1 or similar, the simulated result indicates an example simulating $S_{11}$ when the AC voltage is applied from the first feed position 16-1 and the frequency of the AC voltage is changed, based on the voltage and voltage reflected at the first feed position 16-1. The voltage source is assumed to be disposed between the ground pattern 15 and the first feed position 16-1, for example. In FIG. 7, horizontal axis indicates frequency, and vertical axis indicates $S_{11}$ (in decibels), broken line indicates the simulation result of the antenna apparatus 10 without the stub 18, and solid line indicates the simulation result of the antenna apparatus 10 with the stub 18.

As illustrated in FIG. 7, at each frequency equal to or more "1.7 GHz", value of $S_{11}$ of the antenna apparatus 10 with the stub 18 becomes lower than the antenna apparatus 10 without the stub 18, and the reflected voltage is also lower. Hence, $S_{11}$ of the antenna apparatus 10 with the stub 18 is improved compared with the antenna apparatus 10 without the stub 18. For example, in the antenna apparatus 10 illustrated in FIG. 1 and similar, each of the elements provided on the substrate 12 can obtain radio signal near maximum output of the "1.7 GHz" radio signal received by the antenna elements 14-1 and 14-2.

In view of the above, simulation results is explained that the coupling, antenna efficiency, matching, and similar of the antenna apparatus 10 illustrated in FIG. 1 and similar is improved. Next, the reason for such improvement is explained. FIG. 8A to FIG. 11 are used to explain the reason of various improvements.

Figure 8A:
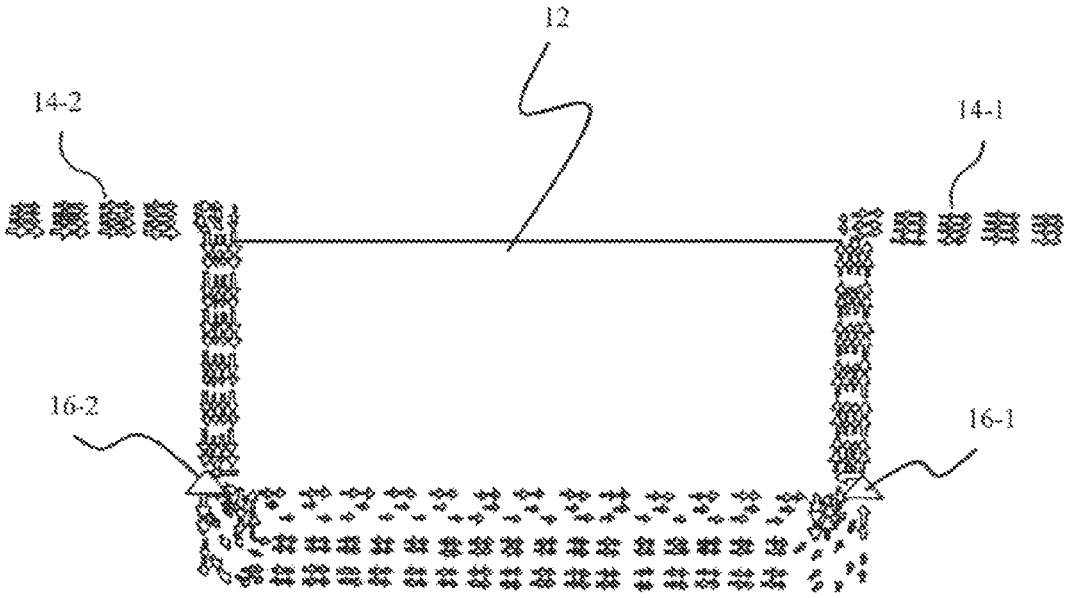
FIG. 8A and FIG. 8B illustrate examples of simulation result of current distribution.
Figure 8B:
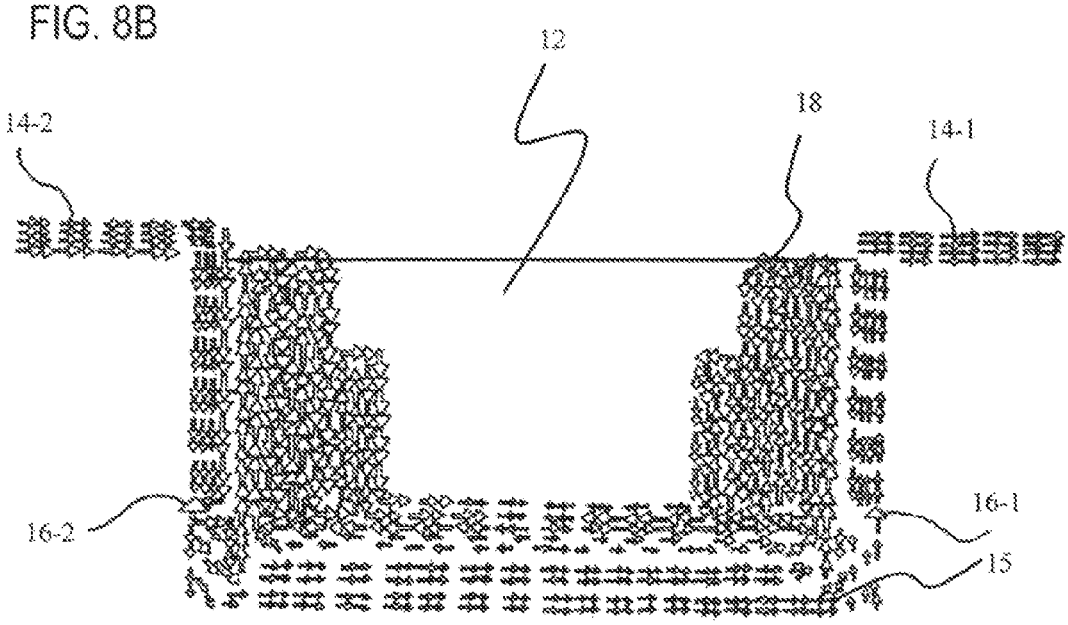

Of these, FIG. 8A and FIG. 8B are used to explain reason of improvement of the coupling and antenna efficiency. FIG. 8A illustrates simulation result indicating an example of current distribution in the antenna apparatus 10 without the stub 18, when the AC voltage is applied from the second feed position 16-2. On the other hand, FIG. 8B illustrates simulation result indicating an example of the current distribution in the antenna apparatus 10 with the stub 18, when the AC voltage is applied from the second feed position 16-2. Both cases are examples in which the AC voltage frequency is "1.7 GHz". In FIG. 8A and FIG. 8B, size and thickness of arrow indicate current magnitude.

Focusing on the first antenna element 14-1 which is not being fed, larger amount of the current of the case that there is without stub 18 (FIG. 8A) is flowing than the case that there is the stub 18 (FIG. 8B). In the antenna apparatus 10 without the stub 18, due to the larger amount of the current flowing in the first antenna element 14-1, the coupling (or $S_{11}$) with the second antenna element 14-2 is stronger than the case that there is the stub 18. Further, in the antenna apparatus 10 without the stub 18, due to the larger amount of the current flowing in the first antenna element 14-1, power consumed in proximity to the first feed position 16-1 is greater than the case that there is the stub 18. Hence, the energy efficiency of the antenna apparatus 10 without the stub 18 is lower than the antenna apparatus 10 with the stub 18.

On the other hand, when there is the stub 18, larger amount of the current equal to or greater than a predetermined value flows in the stub 18 and the part of the ground pattern 15, as illustrated in FIG. 8B. Due to the larger amount of the current flowing in the stub 18 and similar, the current flowing in the first antenna element 14-1 is small compared with the case that there is the stub 18. Hence, the result is obtained that the coupling between the two antenna elements 14-1 and 14-2 of the antenna apparatus 10 with the stub 18 is lower than the antenna apparatus 10 without the stub 18 (for example, FIG. 3). Also, with respect to the energy efficiency, for example in proximity to the first feed position 16-1, the result is obtained that power consumption of the antenna apparatus 10 with the stub 18 is lower and energy efficiency is higher than the antenna apparatus 10 without the stub 18 (for example, FIG. 4). In this way, by including the antenna apparatus 10 with the stub 18, the path of high-frequency current flowing in the antenna elements 14-1 and 14-2 and similar and the impedance can be changed, and characteristic equal to or greater than the predetermined value can be obtained with respect to the coupling and energy efficiency.

Figure 9:
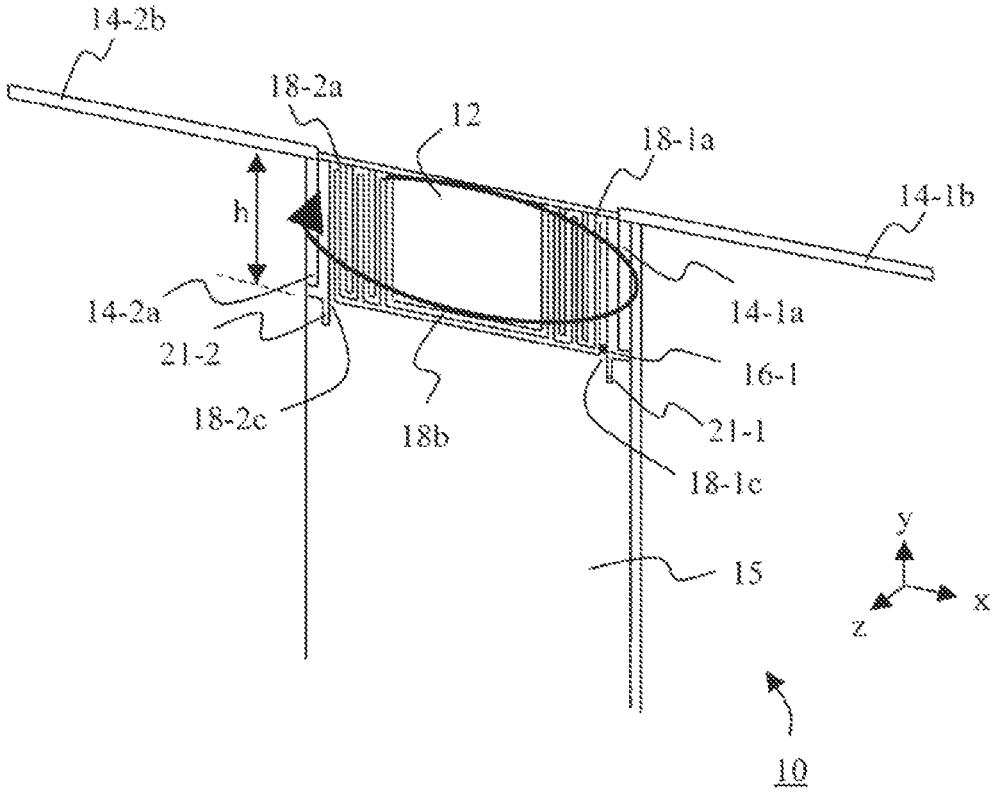
FIG. 9 illustrates a perspective view of an antenna apparatus.
Figure 10A:
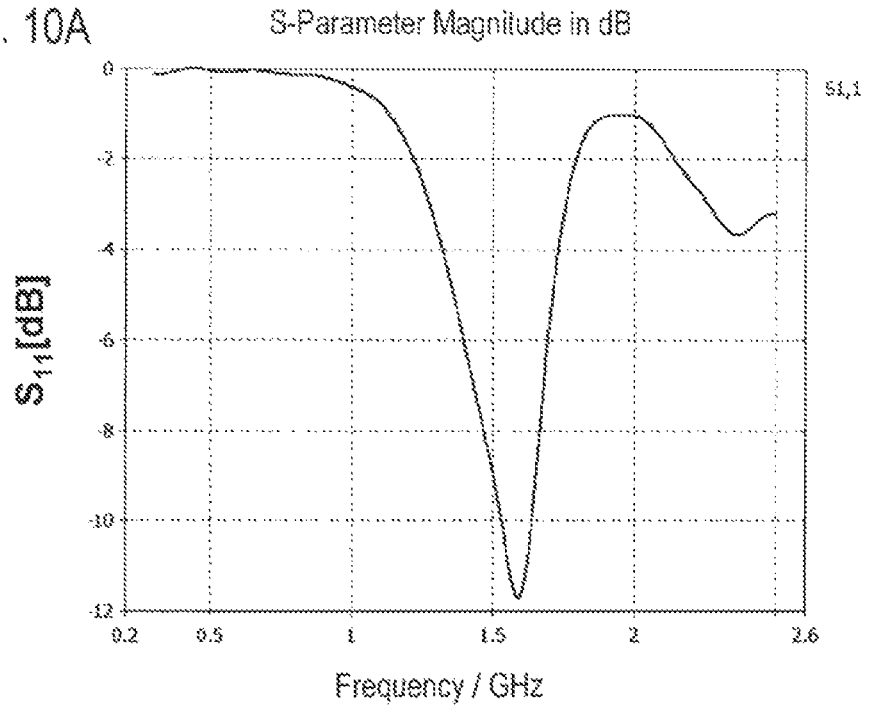
FIG. 10A illustrates an example of simulation result relating to $S_{11}$.
Figure 10B:
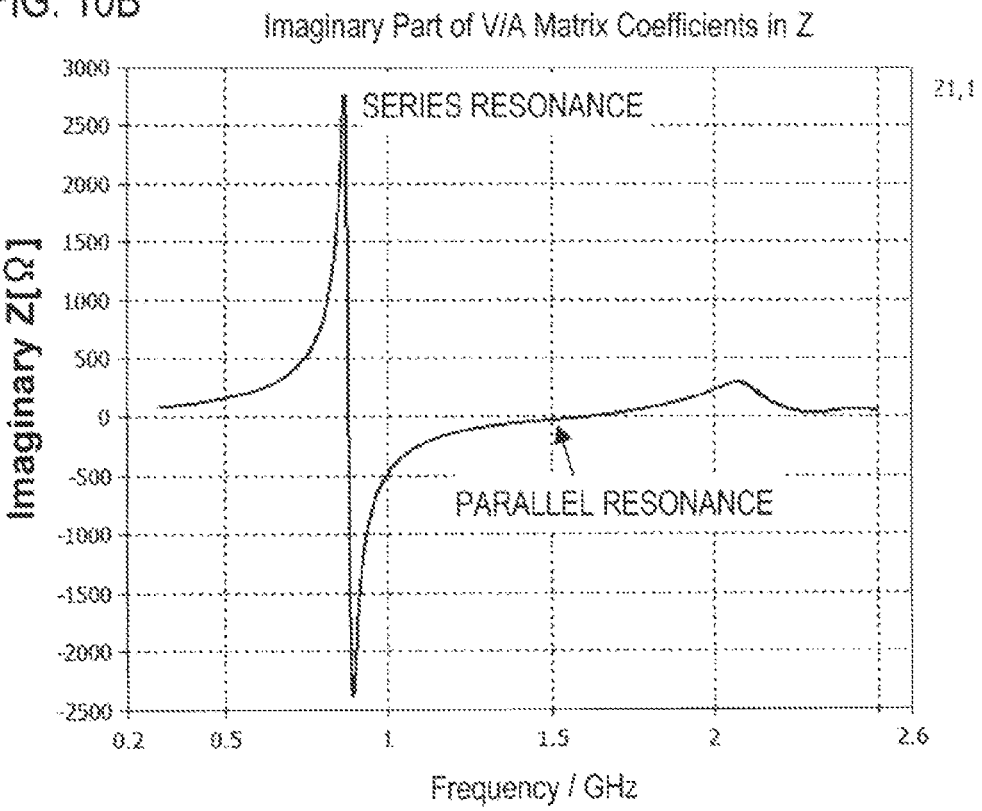
FIG. 10B illustrates simulation result of imaginary part (reactance) of combined impedance of the stub 18.

Next, FIG. 9 to FIG. 10B are used to explain reason for the larger amount of the current equal to or greater than the predetermined value flowing in the stub 18 and similar at frequency "1.7 GHz". FIG. 9 illustrates a perspective view of the antenna apparatus 10 for simulation. In the simulation, in order to investigate center frequency of the stub 18 and similar, the first feed position 16-1 (or port) is provided on the first connection unit 18-1*c* of the stub 18, and the AC voltage of "1.7 GHz" is applied from the feed position 16-1. Additionally, on performing the simulation, each of the heights h in y-axis direction of the meander units 18-1*a* and 18-2*a* of the stub 18 is assumed to be the same length. The electrical length illustrated in FIG. 9 is assumed to be also substantially the same length as wavelength of the frequency "1.7 GHz".

FIG. 10A illustrates simulation result of $S_{11}$ to the first antenna element 14-1 upon feeding to the stub 18 in this way. Further, FIG. 10B illustrates simulation result of imaginary part (reactance) of combined impedance of the stub 18. FIG. 10B illustrates simulation result of the reactance of equivalent circuit to loop path from the first feed position 16-1 via the meander unit 18-1*a* and similar of the stub 18, arriving at the second connection unit 18-2*c*, and then returning to the first feed position 16-1, for example.

As illustrated in FIG. 10A, lower value is obtained with respect to $S_{11}$ at frequency "1.7 GHz" compared with at other frequencies. And as illustrated in FIG. 10B, the reactance at frequency "1.7 GHz" is "0", and the stub 18 and similar become in the parallel resonance condition. By becoming the stub 18 and similar the parallel resonance condition, the large amount of the current equal to or greater than the predetermined value flows in the stub 18 and similar, as for example illustrated in FIG. 8B.

That is, the electrical length formed by the stub 18 and the part of the ground pattern 15 is substantially the same length as the wavelength (for example, at frequency "1.7 GHz") of radio signal transmitted or received in the antenna apparatus 10. In this way, the stub 18 and similar become the parallel resonance condition at the frequency of the radio signal, and the larger amount of the current equal to or greater than the predetermined value flows in the stub 18 and similar. Additionally, value taking into dielectric constant of the substrate 12 may be same length as one wavelength of the radio signal.

Figure 11:
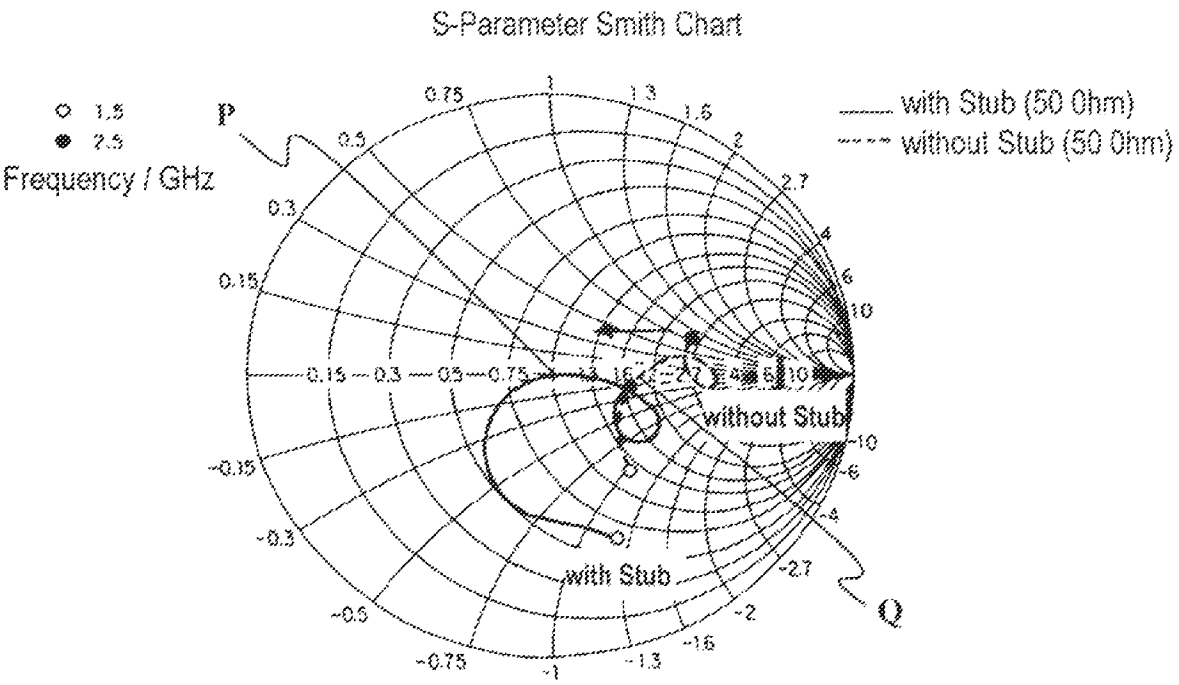
FIG. 11 illustrates an example of smith chart.

Next, the reason for improvement of the matching at frequency "1.7 GHz" is explained. FIG. 11 is a Smith chart illustrating an example of impedance change in the antenna apparatus 10 with the stub 18 and in the antenna apparatus 10 without the stub 18, as illustrated in FIG. 1 and similar. This simulation illustrates an example of changes in impedance of the first antenna element 14-1, when the AC voltage is applied from the first feed position 16-1 of the antenna apparatus 10 and the frequency of the AC voltage is changed from "1.5 GHz" to "2.5 GHz", for example. In FIG. 11, horizontal axis indicates real part of the impedance (or pure resistance), and upper half of vertical axis indicates inductive region, while lower half indicates capacitive region. In FIG. 11, solid line indicates simulation result of the antenna apparatus 10 with the stub 18, and broken line indicates simulation result of the antenna apparatus 10 without the stub 18.

As illustrated in FIG. 11, when there is the stub 18, point P at which graph and horizontal axis come in contact with each other is "1", and simulation result is obtained that the matching is improved. On the other hand, when there is without the stub 18, the point Q at which the graph and the horizontal axis come in contact with each other is a point between "1.6" and "2", and simulation result is obtained that the matching is not improved. From these simulation results, the matching of the antenna apparatus with the stub 18 is improved compared with the antenna apparatus 10 without the stub 18 at low impedance of the first antenna element 14-1. Hence, reflection coefficient of the antenna apparatus 10 with the stub 18 is lower than the antenna apparatus 10 without the stub 18, and the simulation result is obtained that $S_{11}$ of the antenna apparatus 10 with the stub 18 is lower than without the stub 18 as illustrated in FIG. 7 and similar.

Additionally, as illustrated in FIG. 2 and similar, it is known that by providing the metal face in proximity to (for example, within a distance href) each of the antenna elements 14-1 and 14-2, radiation resistance and similar become low value equal to or less than a predetermined value, and the graph on the Smith chart moves in direction indicated by the arrow in FIG. 11. In the antenna apparatus 10, because the meander units 18-1*a* and 18-2*a* of the stub 18 are provided in proximity to the antenna elements 14-1 and 14-2, the radiation resistance becomes the low value equal to or less than the predetermined value, and the matching and similar are also improved.

In this way, in the first embodiment, by providing the stub 18 between the antenna elements 14-1 and 14-2, when the frequency of the AC current input from the first feed position 16-1 is "1.7 GHz", simulation result of predetermined characteristic is obtained. Hence, when the frequency of radio signal transmitted or received is "1.7 GHz", with respect to the characteristic such as the coupling and matching, predetermined characteristic can be obtained.

Further, because the antenna apparatus 10 does not includes a cutout, slit or similar of size equal to or greater than a predetermined value indicated in Japanese Laid-open No. 2007-13643 Patent Publication and Japanese Laid-open No. 2007-243455 Patent Publication, small size or reduced space can be achieved in the antenna apparatus 10. And, the stub 18 is not directly connected to the antenna elements 14-1 and 14-2, but is directly connected to the ground pattern 15. Hence, the characteristics of the antenna elements 14-1 and 14-2 are unchanged, and a separate matching circuit or similar may not be provided. Hence, the cost of the antenna apparatus 10 can also be reduced.

(Second Embodiment)

Next, a second embodiment is explained. In the first embodiment, the stub 18 is explained as including meander units 18-1*a*, 18-2*a*, 18-1*d*, and 18-2*d*, the straight-line unit 18*b*, and similar. If the electrical length formed by the stub 18 and similar is substantially equal to one wavelength of the frequency of radio signal transmitted or received in the antenna apparatus 10, then shape of the stub 18 may be any shape.

Figure 12A:
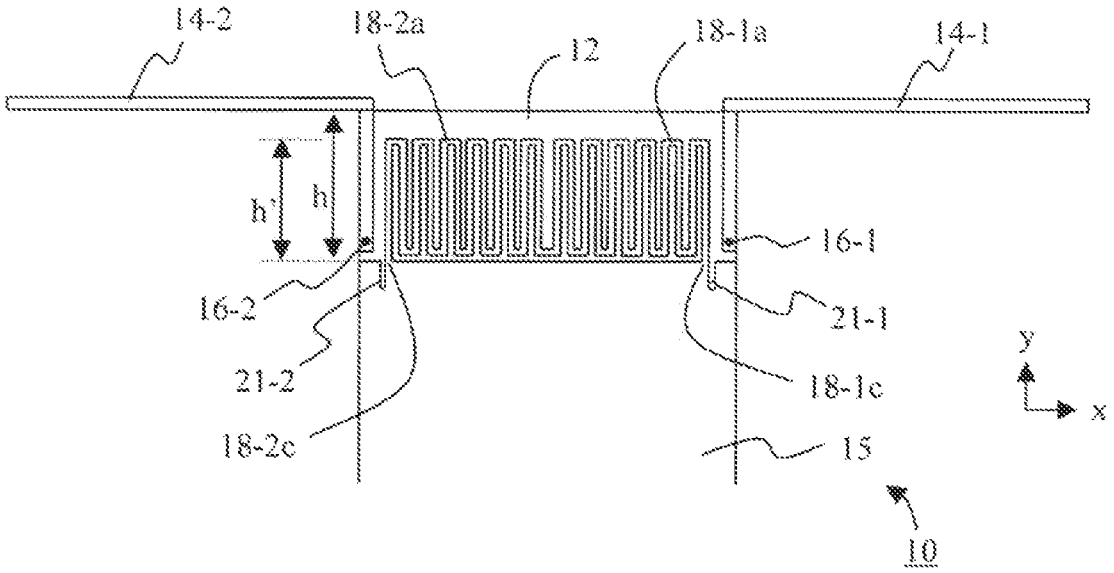
FIG. 12A illustrates an enlarged view of an antenna apparatus.

FIG. 12A illustrates another example of the stub 18. The stub 18 includes the meander units 18-1*a* and 18-2*a* entirely. However, the height h' in y-axis direction of the stub 18 is shorter than with the height h in the first embodiment.

Figure 12B:
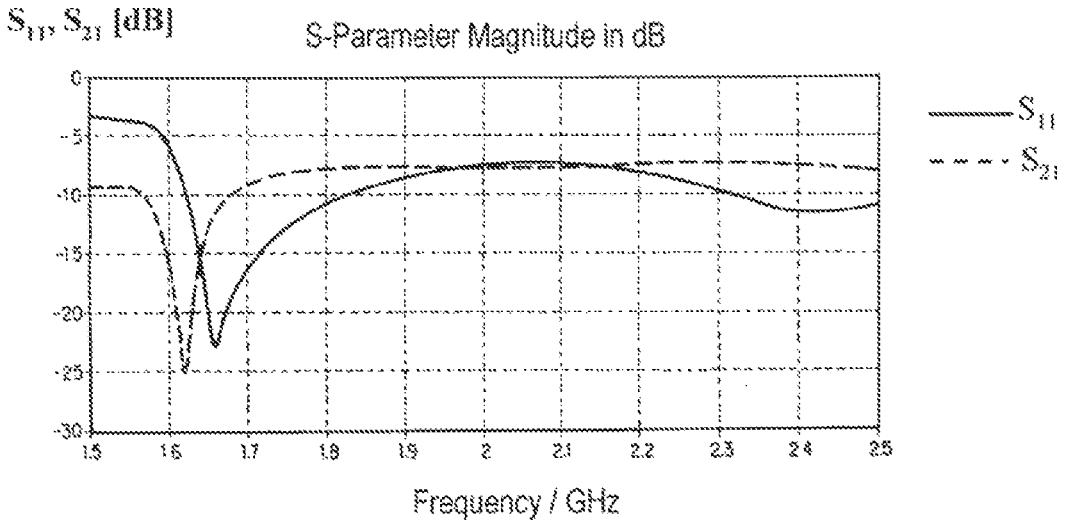
FIG. 12B illustrates an example of simulation result.

FIG. 12B illustrates an example of simulation result of $S_{21}$ and $S_{11}$ on performing simulation similar to the first embodiment. In FIG. 12B, broken line indicates $S_{21}$ and solid line indicates $S_{11}$.

As illustrated in FIG. 12B, the coupling ($S_{21}$) between the antenna elements 14-1 and 14-2, and the matching ($S_{11}$) of the first antenna element 14-1, can also take on lower values at "1.7 GHz" compared with other frequencies (or compared with the case of without stub 18), and improved results can be obtained.

Additionally, simulation results relating to the antenna efficiency and correlation coefficient is "−0.9 dB" and "0.04" at the frequency "1.7 GHz", respectively. Both are still lower value compared with the first embodiment, so that still more improved result can be obtained.

From the above, the simulation results of predetermined characteristic or greater can be obtained, if wavelength of the AC voltage input from the first feed position 16-1 (for example, an AC voltage with frequency "1.7 GHz") and the electrical length are substantially the same, even if the shape of the stub 18 and similar is any kind of the shape. Hence, predetermined characteristic or greater can be obtained in the antenna apparatus 10, if the wavelength of the radio signal transmitted or received (for example, the radio signal of frequency "1.7 GHz") and the electrical length are substantially the same, even if the shape of the stub 18 and similar is any kind of the shape.

Also, the antenna apparatus 10 does not include the cutout, slit or similar of size equal to or greater than the predetermined value indicated in Japanese Laid-open No. 2007-13643 Patent Publication or Japanese Laid-open No. 2007-243455 Patent Publication, therefore, the reduced space or small size can be obtained in the antenna apparatus 10. And, the antenna apparatus may not include the separate matching circuit or similar to obtain the characteristic of the antenna elements 14-1 and 14-2, so that costs and similar can also be reduced.

(Third Embodiment)

Figure 13A:
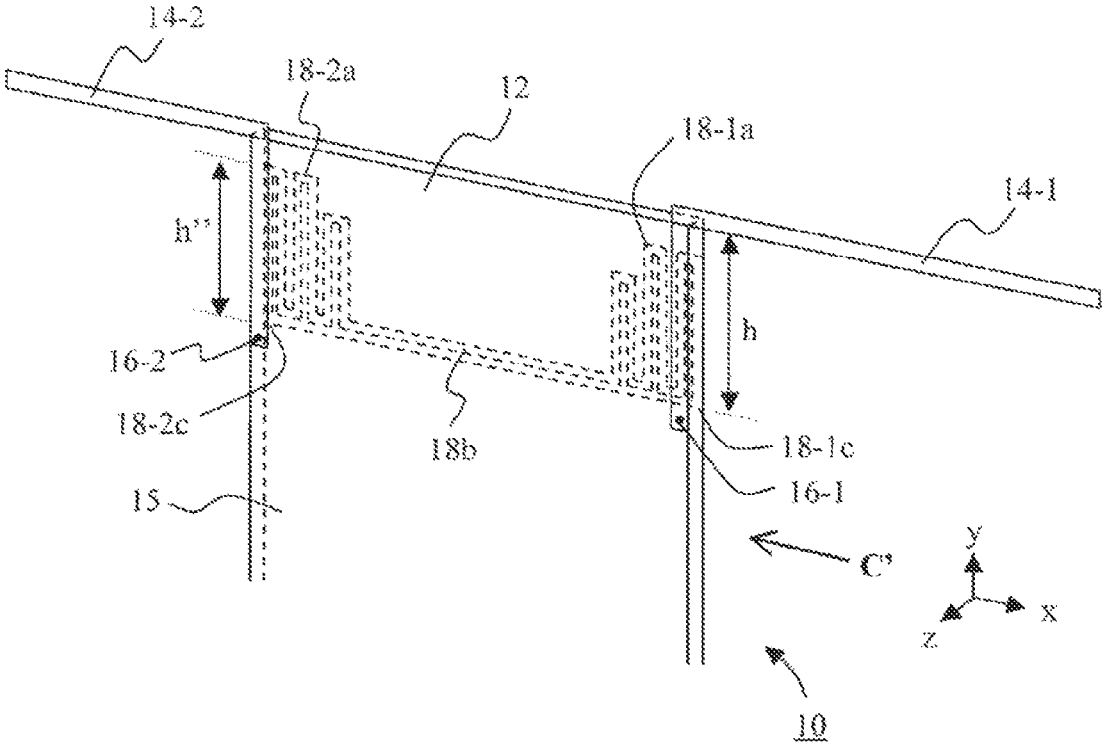
FIG. 13A illustrates a perspective view of an antenna apparatus.
Figure 13B:
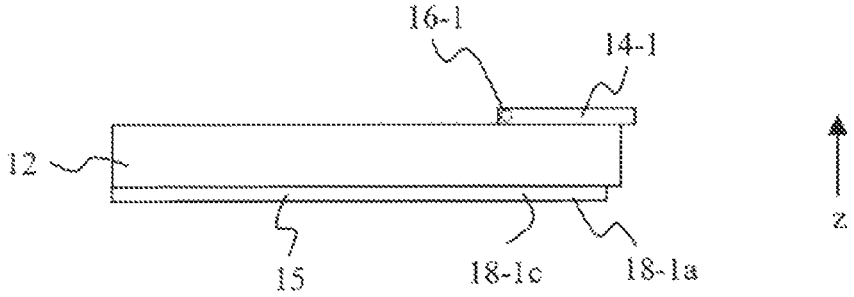
FIG. 13B illustrates a cross-sectional view of an antenna apparatus.

Next, a third embodiment is explained. In the first embodiment and similar, the case is explained in which the antenna apparatus 10 includes the antenna elements 14-1 and 14-2, the stub 18, and similar on one face (for example, the top surface) of the substrate 12. For example, the antenna elements 14-1 and 14-2 may be provided on the top surface of the substrate 12, and the ground pattern 15 and stub 18 may be provided on the bottom surface. FIG. 13A and FIG. 13B illustrate perspective views of the antenna apparatus 10 of the third embodiment, and FIG. 14 illustrates an example of simulation result of the third embodiment.

The antenna apparatus 10 includes the antenna elements 14-1 and 14-2 and stub 18 provided in opposition in the thickness direction (z-axis direction). For example, the antenna elements 14-1 and 14-2 are provided on the top surface of the substrate 12, and the stub 18 and ground pattern 15 are provided on the bottom surface of the substrate 12.

The shape of the stub 18 is such that the height h" in y-axis direction is shorter than the height h in the first embodiment. Similarly to the first embodiment and similar, the stub 18 is connected via the connection units 18-1*c* and 18-2*c* to the ground pattern 15, and includes the meander units 18-1*a* and 18-2*a* on the sides of the antenna elements 14-1 and 14-2. Also, the two meander units 18-1*a* and 18-2*a* are connected by the straight-line unit 18*b*. The electrical length formed by the stub 18 and part of the ground pattern 15 is substantially the same length as one wavelength of radio signal transmitted and received in the antenna apparatus 10 (for example, radio signal with frequency "1.7 GHz").

Figure 14:
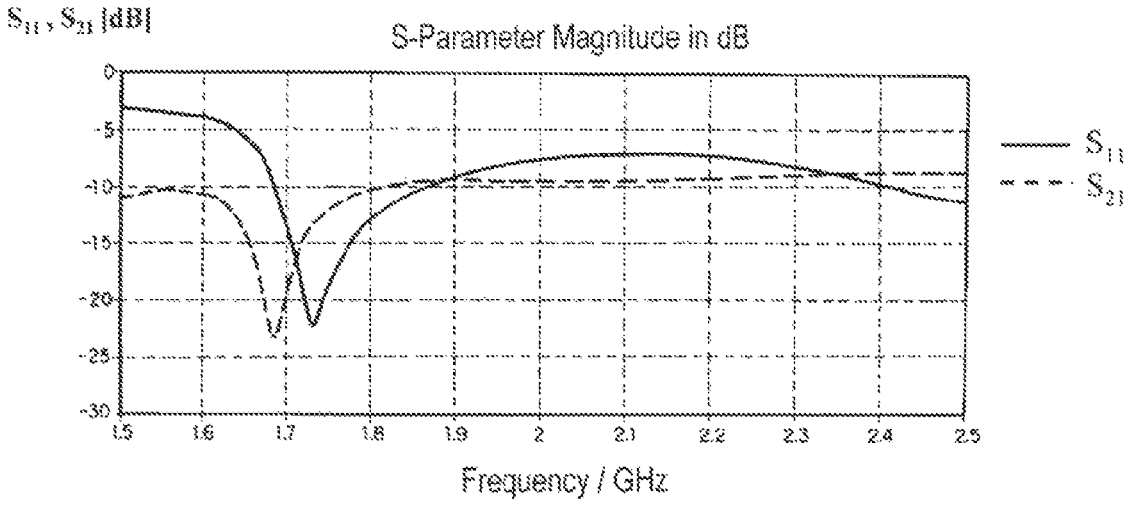
FIG. 14 illustrates an example of simulation result of $S_{11}$ and $S_{21}$.

FIG. 14 illustrates an example of simulation result of $S_{21}$ and $S_{11}$, on performing simulation similar to the first embodiment. Similarly to the first embodiment, the simulation result indicating a low value at "1.7 GHz" compared with other frequencies (or compared with the case of without stub 18) can be obtained. Additionally, with respect to the antenna efficiency and correlation coefficient, values of "−1.4 GHz" and "0.08" can be obtained at frequency "1.7 GHz", respectively.

The simulation results can be obtained of the antenna apparatus 10 indicating predetermined value of the coupling, matching, and other characteristics when the input AC voltage frequency is "1.7 GHz". Hence, predetermined characteristic can be obtained in the antenna apparatus 10 when the frequency of the radio signal transmitted or received is "1.7 GHz", for example. Also, the antenna apparatus 10 does not include the cutout, slits or similar of size equal to or greater than the predetermined value indicated in Japanese Laid-open No. 2007-13643 Patent Publication or Japanese Laid-open No. 2007-243455 Patent Publication, the reduced space or smaller size can be achieved in the antenna apparatus 10. Further, the antenna apparatus may not include the separate matching circuit or similar, so that costs can also be reduced.

(Fourth Embodiment)

Figure 15A:
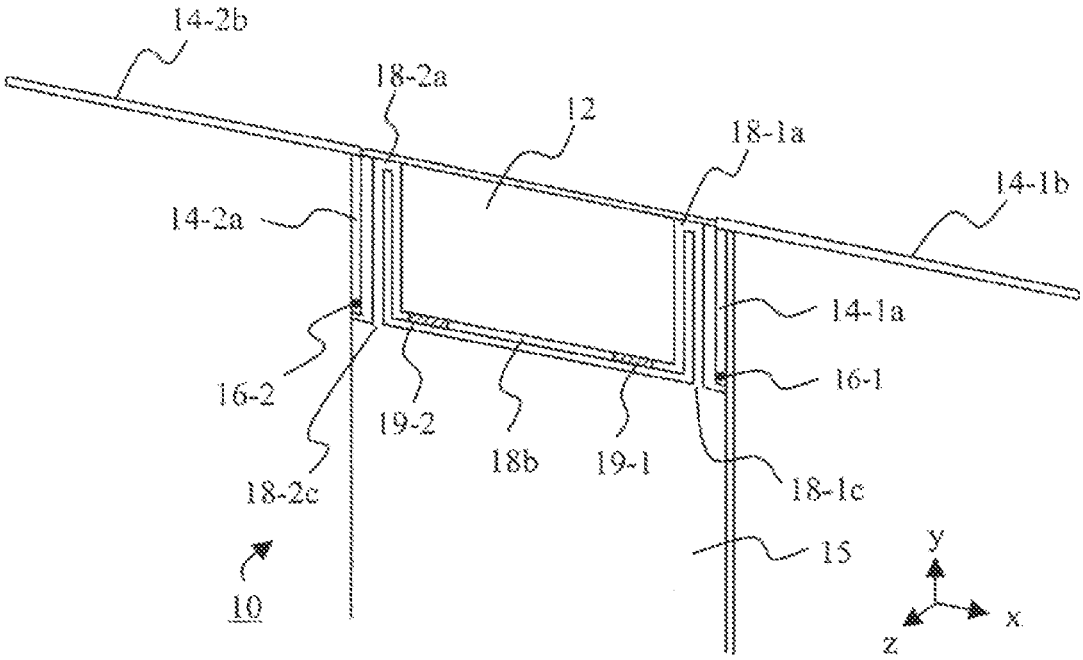
FIG. 15A illustrates a perspective view of an antenna apparatus.
Figure 15B:
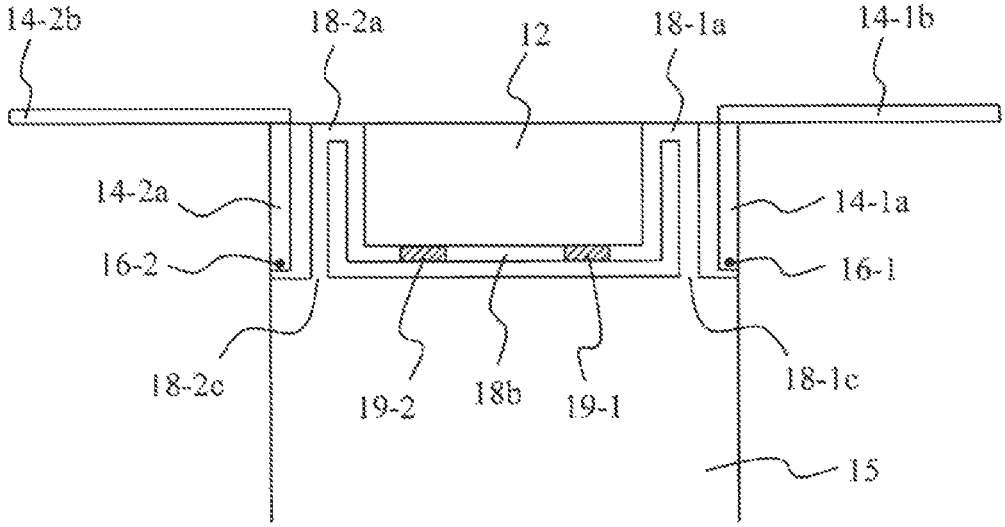
FIG. 15B illustrates an enlarged view of an antenna apparatus.

Next, a fourth embodiment is explained. FIG. 15A illustrates a perspective view of the antenna apparatus 10 of the fourth embodiment, and FIG. 15B illustrates an enlarged view of the antenna apparatus 10.

The antenna apparatus 10 includes, in the stub 18, lumped constant elements 19-1 and 19-2 such as capacitor, coil, resistance, and similar. For example, by adjusting the capacitance, inductance, resistance, and similar of the lumped constant elements 19-1 and 19-2, antenna coupling between the stub 18 and antenna elements 14-1 and 14-2, the loop length (or electrical length) of the stub 18 and ground pattern 15, and similar can be adjusted. Further, by adjusting the capacitance and similar of the lumped constant elements 19-1 and 19-2, manufacturing error in the antenna elements 14-1 and 14-2, feed positions 16-1 and 16-2, stub 18, and similar can be absorbed. FIG. 15A and FIG. 15B illustrate examples of two lumped constant elements 19-1 and 19-2, but the number of the lumped constant element may be one, three or more. Further, similarly to the first embodiment, the meander units 18-1*a* and 18-2*a* of the stub 18 are provided in proximity to the antenna elements 14-1 and 14-2.

Figure 16:
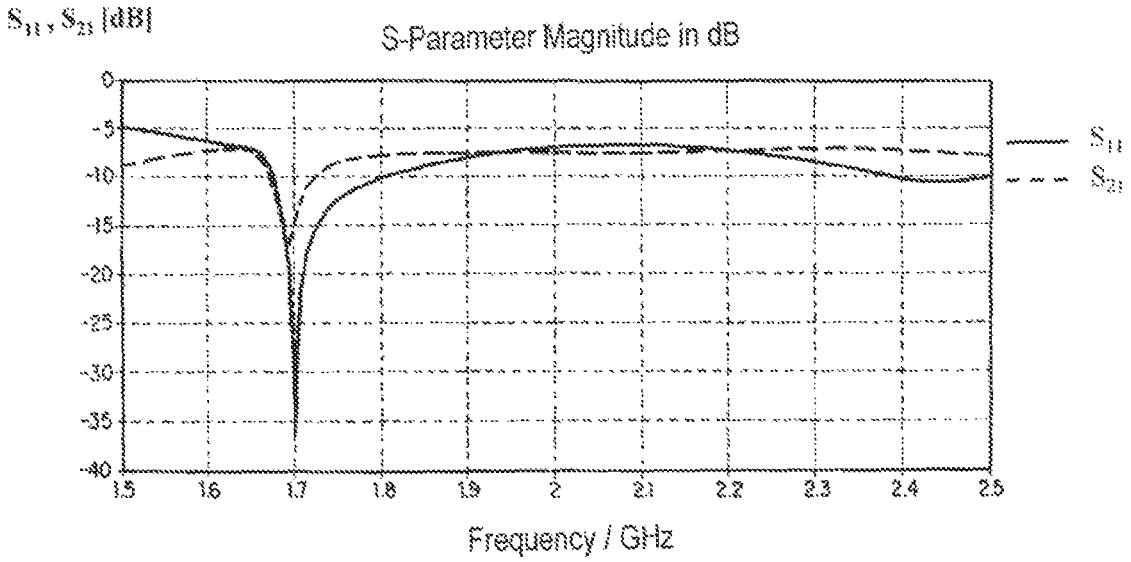
FIG. 16 illustrates an example of simulation result of $S_{11}$ and $S_{21}$.

FIG. 16 illustrates examples of simulation results of $S_{21}$ and $S_{11}$, in the case of performing simulation similar to the first embodiment. However, the simulation is performed on condition that the inductance of the lumped constant elements 19-1 and 19-2 is "7 nH". In FIG. 16, broken line is a graph of $S_{21}$, and solid line is a graph of $S_{11}$.

As illustrated in FIG. 16, even when the lumped constant elements 19-1 and 19-2 are provided in the stub 18, lower value is obtained at frequency "1.7 GHz" in the antenna apparatus 10 than at other frequencies. Additionally, simulation result can be obtain that the values of the antenna efficiency and correlation coefficient of the antenna apparatus 10 is "−1.2 dB" and "0.07" at frequency "1.7 GHz", respectively. These values are low values compared with simulation result in the case of without the stub 18 illustrated in FIG. 4 and FIG. 6, and improved result can be obtain.

Therefore, in the fourth embodiment, by including the lumped constant elements 19-1 and 19-2 in the stub 18, the prescribed characteristic can be obtained in the antenna apparatus 17 when the frequency of the radio signal transmitted or received is "1.7 GHz", for example. Further, the antenna apparatus 10 does not include the cutout, slit or similar of size equal to or greater than the constant value indicated in Japanese Laid-open No. 2007-13643 Patent Publication or Japanese Laid-open No. 2007-243455 Patent Publication, therefore, the reduced space and smaller size can be achieved in the antenna apparatus 10. And, the antenna apparatus 10 does not include the matching circuit to perform matching of the antenna elements 14-1 and 14-2, so that cost and similar can also be reduced.

(Fifth Embodiment)

Figure 17:
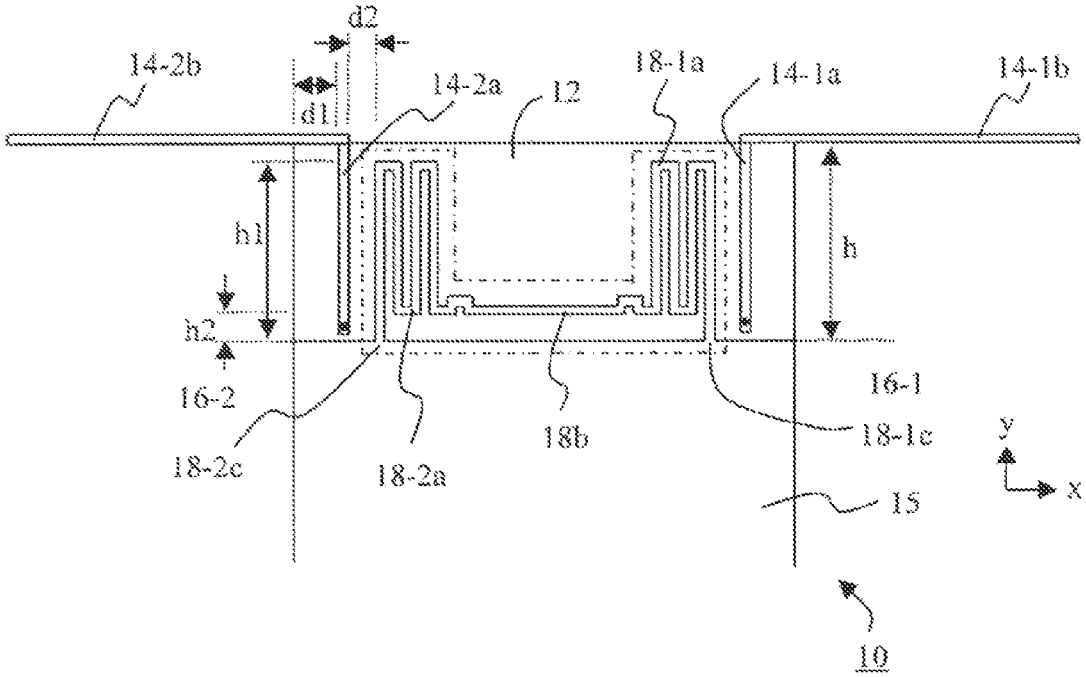
FIG. 17 illustrates an enlarged view of an antenna apparatus.

Next, a fifth embodiment is explained. In the first to fourth embodiments, the examples are explained in which improved result is obtained at the frequency of "1.7 GHz". For example, by changing the shape of the stub 18, the improved result can also be obtained at other frequencies. FIG. 17 illustrates an enlarged view of the antenna apparatus 10, and FIG. 18A to FIG. 21B illustrate examples of simulation result and similar.

As illustrated in FIG. 17, height h1 in y-axis direction of the meander units 18-1*a* and 18-2*a* of the stub 18 is shorter than the height h in the first embodiment. Further, the distance d2 between the meander units 18-1*a* and 18-2*a* and the fixed units 14-1*a* and 14-2*a* of the antenna elements 14-1 and 14-2 is longer than the case of the first embodiment. Further, the distance h2 between the straight-line unit 18*b* of the stub 18 and the ground pattern 15 is also longer than the case of the first embodiment. And, the fixed units 14-1*a* and 14-2*a* of the antenna elements 14-1 and 14-2 are provided on the center side of the substrate 12 at the distance d2 in x-axis direction. The electrical length formed by the stub 18 and part of the ground pattern 15 is substantially the same length as one wavelength corresponding to the frequency "2.5 GHz".

Figure 18A:
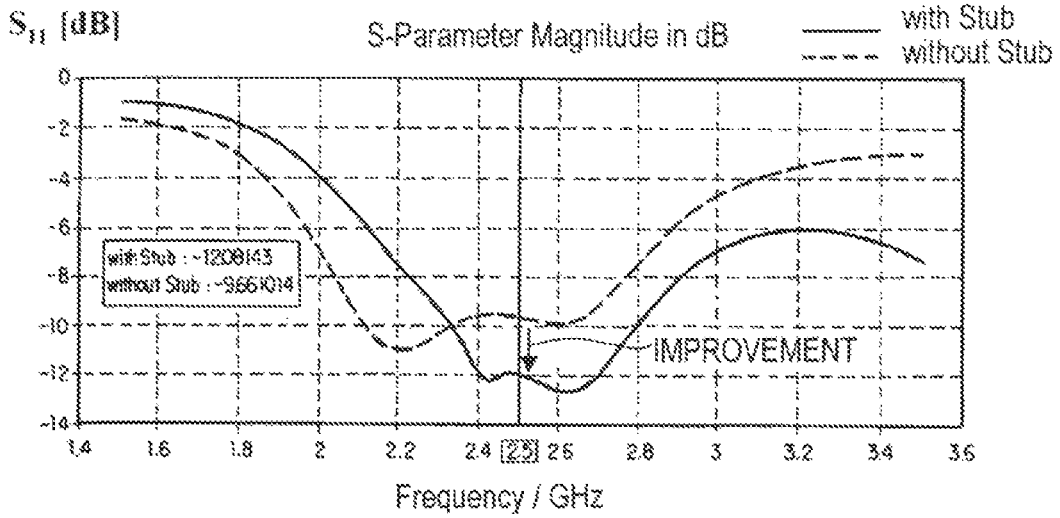
FIG. 18A illustrates an example of simulation result of $S_{11}$.
Figure 18B:
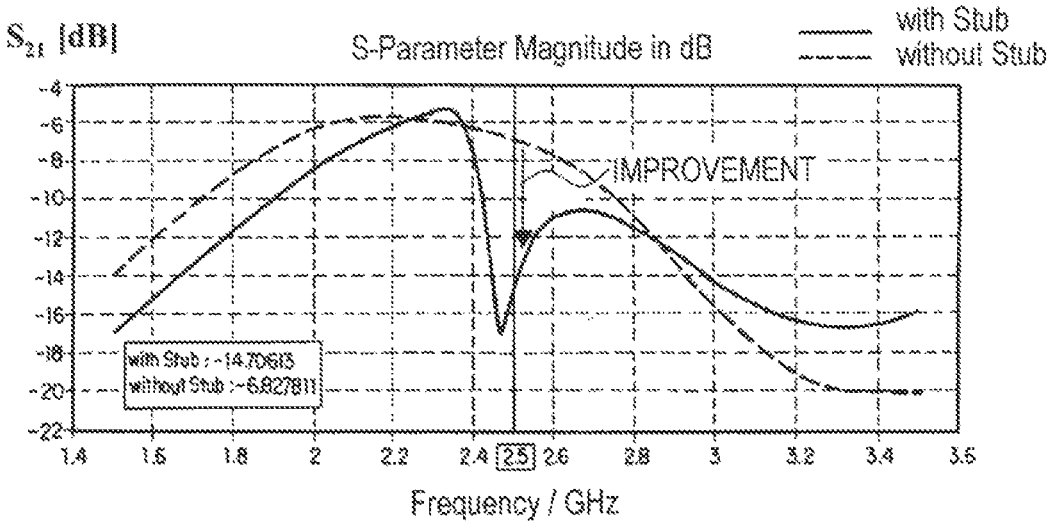
FIG. 18B illustrates an example of simulation result of $S_{21}$.

FIG. 18A and FIG. 18B illustrate simulation results in a case that, similarly to the first embodiment, for example, the AC voltage is applied to the first feed position 16-1, and the frequency of the AC voltage is changed. Of these, FIG. 18A illustrates an example of simulation result of $S_{11}$ of S parameter, and FIG. 18B illustrates an example of simulation result of $S_{21}$, respectively. In the FIG. 18A and FIG. 18B, solid line is a graph in the case that there is the stub 18, and broken line is a graph in the case that there is without the stub 18.

As illustrated in FIG. 18A and FIG. 18B, values of both $S_{11}$ and $S_{21}$ of the antenna apparatus 10 with the stub 18 is lower at "2.5 GHz" than the antenna apparatus 10 without the stub 18, and improved simulation result can be obtained.

Figure 19B:
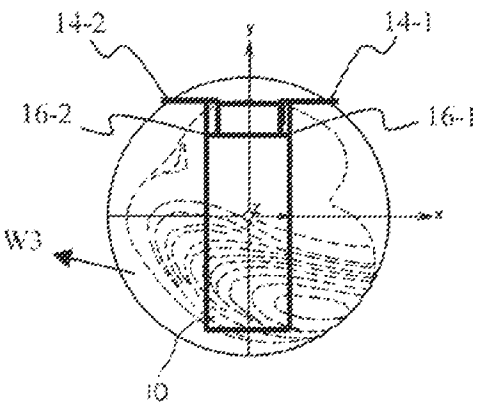
FIG. 19A and FIG. 19B illustrate examples of simulation result of radiation pattern.
Figure 19A:
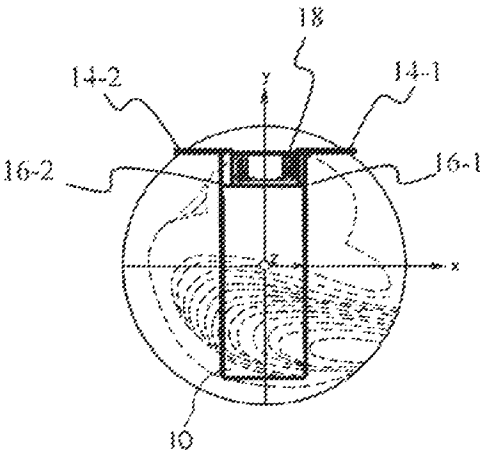
Figure 20:
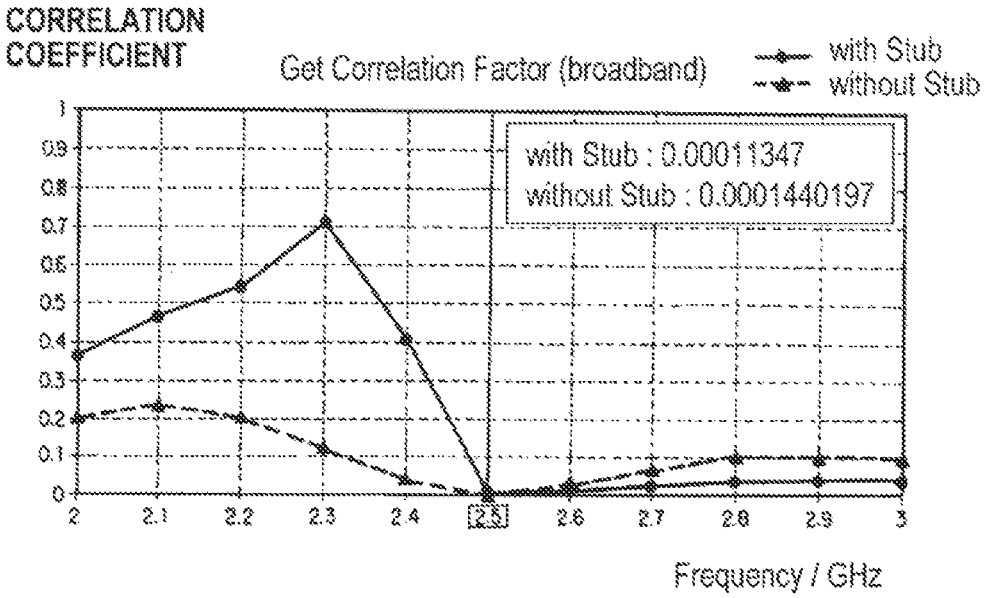
FIG. 20 illustrates an example of simulation result of correlation coefficient.

FIG. 19A and FIG. 19B illustrate simulation results of radiation pattern, and FIG. 20 illustrates simulation result of the correlation coefficient.

Of these, FIG. 19A and FIG. 19B illustrate examples of simulation results of the radiation pattern near the antenna apparatus 10 when the AC voltage is applied from the first feed position 16-1. FIG. 19A illustrates the example with the stub 18, and FIG. 19B illustrates the example without the stub 18.

As illustrated in FIG. 19A and FIG. 19B, the highest power is distributed in the first quadrant of x-axis and the second quadrant of y-axis in both cases. Comparing with the two results, higher power is distributed in the direction (the W3 direction) of the second antenna element 14-2 not being fed in the case of the antenna apparatus 10 without the stub 18, rather than the antenna apparatus 10 with the stub 18. From this, the coupling of the antenna elements 14-1 and 14-2 of the antenna apparatus 10 with the stub 18 is lower than the antenna apparatus 10 without the stub 18.

Further, FIG. 20 illustrates an example of the correlation coefficient, solid line indicates with stub 18, and broken line indicates without the stub 18, in FIG. 20. As illustrated in FIG. 20, regardless of whether the stub 18 is present or not, sufficient low value of the correlation coefficient can be obtained at "2.5 GHz".

Additionally, the simulation results is obtained that value of the antenna efficiency of the antenna apparatus 10 with the stub 18 is "−0.94 dB", and the value of the antenna apparatus without the stub 18 is "−1.707 dB". With respect to antenna efficiency, higher value can be obtained of the antenna apparatus 10 with the stub 18 than the antenna apparatus 10 without the stub 18, and improved result can be obtained.

Figure 21B:
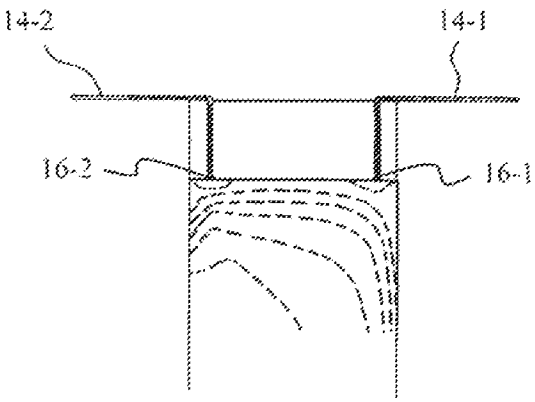
FIG. 21A and FIG. 21B illustrate examples of simulation result of current distribution.
Figure 21A:
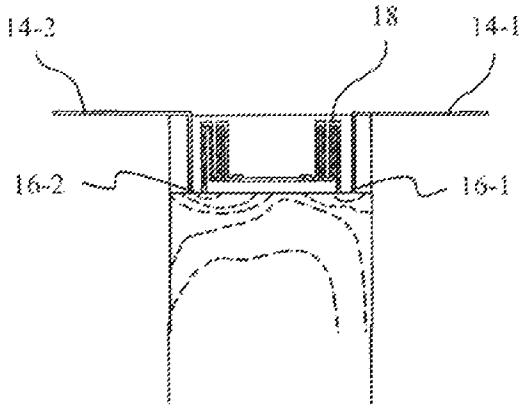

FIG. 21A and FIG. 21B illustrate simulation examples of current distribution when feeding is performed from the first feed position 16-1, similarly to the first embodiment. FIG. 21A illustrate examples of the case that there is the stub 18, and FIG. 21B illustrates example of the case that there is without the stub 18.

As illustrated in FIG. 21A, large current equal to or greater than constant value flows in the stub 18. Further, smaller current flows in the second antenna element 14-2 with the stub 18 (FIG. 21A) not being fed than without the stub 18 (FIG. 21B). Hence, similarly to the first embodiment, the coupling between the antenna elements 14-1 and 14-2 of the antenna apparatus 10 with the stub 18 as illustrated in FIG. 1 is lower than the antenna apparatus 10 without the stub 18. Also, the power consumed in proximity to the second feed position 16-2 is lower and the energy efficiency is higher of the antenna apparatus 10 with the stub 18 than of the antenna apparatus 10 without the stub 18.

From the above, by changing the shape of the stub 18 and similar, with respect to the coupling, matching, and similar characteristic, simulation results of constant characteristic can be obtain when the input AC voltage frequency is "2.5 GHz". Hence, characteristic with constant value or higher can be obtained of the antenna apparatus 10 when the frequency of radio signal transmitted or received is "2.5 GHz", for example.

Further, examples are explained of "1.7 GHz" in the first embodiment and of "2.5 GHz" in the fifth embodiment, but, by changing the shape of the stub 18 and changing position of the fixed units 14-1*a* and 14-2*a* of the antenna elements 14-1 and 14-2 and similar, the constant characteristic can be obtained in other frequencies as well, for example.

Also, similarly to the first example and similar, the antenna apparatus 10 does not include the cutout, slit or similar of size equal to or greater than the constant value indicated in Japanese Laid-open No. 2007-13643 Patent Publication or Japanese Laid-open No. 2007-243455 Patent Publication, so that the reduced space and smaller size can be achieved. And, the antenna apparatus 10 also may not includes the separate matching circuit for the antenna elements 14-1 and 14-2, so that the cost and similar can also be reduced.

(Sixth Embodiment)

Next, a sixth embodiment is explained. The sixth embodiment is a configuration example of the radio terminal apparatus 100 including the antenna apparatus 10.

Figure 22A:
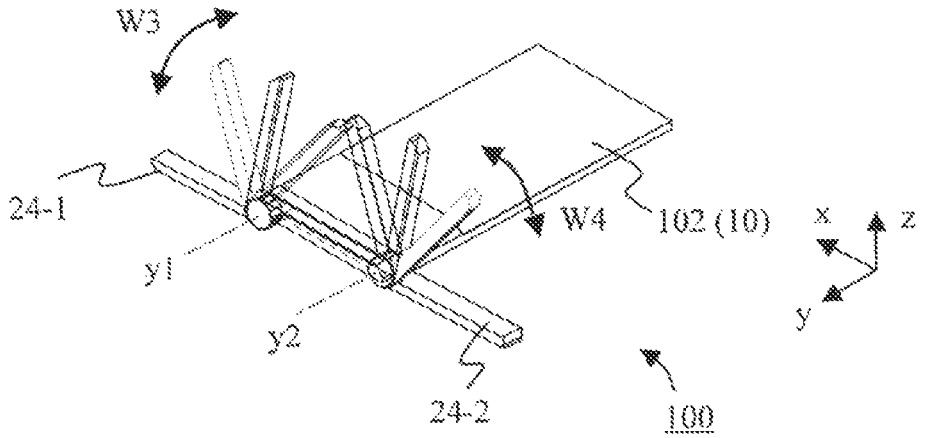
FIG. 22A and FIG. 22B illustrate perspective views of a radio terminal apparatus.
Figure 22B:
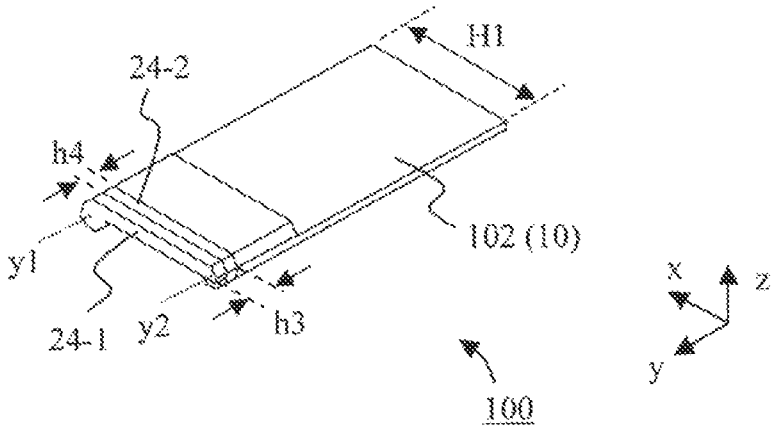

FIG. 22A and FIG. 22B illustrate perspective views of the radio terminal apparatus 100. The radio terminal apparatus 100 includes a housing 102, and the antenna apparatus is accommodate within the housing 102. Antenna units 24-1 and 24-2 (or, first antenna units 24-1 and 24-2) of the housing 102 accommodate the bent units 14-1*b* and 14-2*b* of the antenna elements 14-1 and 14-2.

The antenna units 24-1 and 24-2 are rotatable in W3 and W4 directions about y1-axis and y2-axis, respectively. As illustrated in FIG. 22B, the antenna units 24-1 and 24-2 can be accommodated within the width H1 of the radio terminal apparatus 100 by rotating. For this reason, length h3 in y-axis direction of the first antenna unit 24-1 is longer than length h4 in y-axis direction of the second antenna unit 24-1.

Additionally, it is sufficient that the antenna units 24-1 and 24-2 can be accommodated within the width H1, so that the length h4 of the second antenna unit 24-1 may be longer than the length h3 of the first antenna unit 24-1.

Figure 23A:
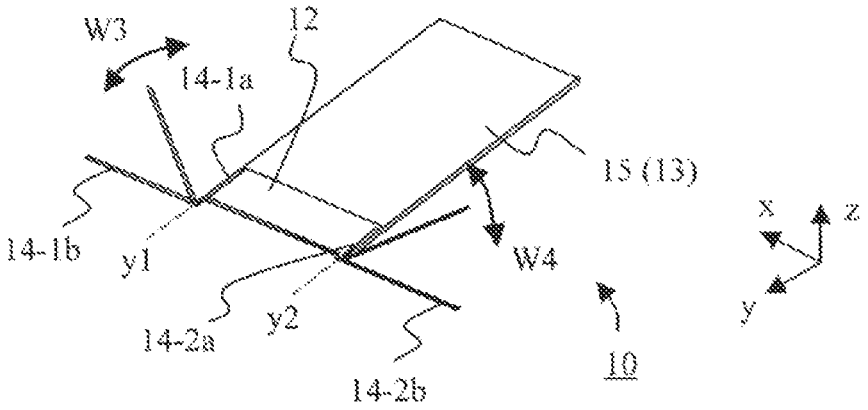
FIG. 23A and FIG. 23B illustrate perspective views of an antenna apparatus.
Figure 23B:
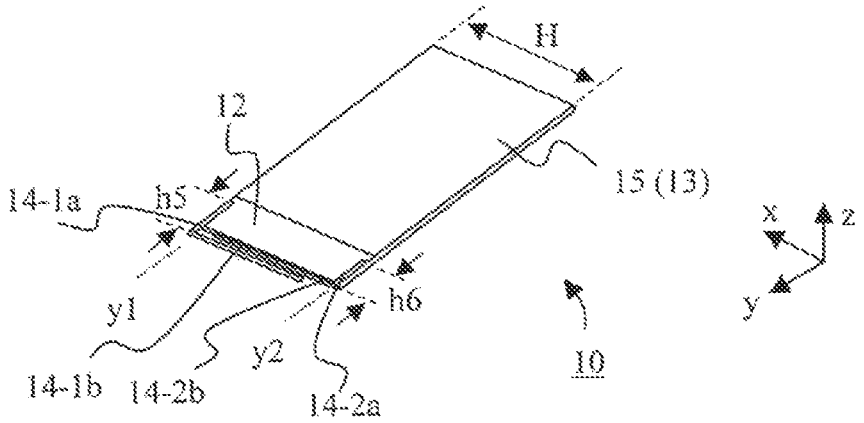

FIG. 23A and FIG. 23B illustrate perspective views of the antenna apparatus 10, and illustrate manner of rotation. The bent units 14-1*b* and 14-2*b* of the antenna elements 14-1 and 14-2 can rotate in the W3 and W4 directions about y1-axis and y2-axis respectively, with rotation of the antenna units 24-1 and 24-2. As illustrated in FIG. 23B, when the bent units 14-1*b* and 14-2*b* rotates, the bent units 14-1*b* and 14-2*b* can accommodate within the width H of the antenna apparatus 10. For this reason, length h5 in y-axis direction of the first fixed unit 14-1*a* is longer than length h6 in y-axis direction of the second fixed unit 14-2*a*. Additionally, it is sufficient that the bent units 14-1*b* and 14-2*b* can be accommodated within the width H, so that the length h6 of the second fixed unit 14-2*a* may be longer than the length h5 of the first fixed unit 14-1*a*.

(Other Embodiments)

In each of the above-described embodiments, the antenna apparatus 10 is explained as including a single substrate 12. The antenna apparatus 10 may include a plurality of substrates 12. Of these, a certain substrate 12 includes the ground pattern 15 and antenna elements 14-1 and 14-2 and similar, as illustrated in FIG. 1 and similar, and the ground pattern 15 forms a ground to the elements on other substrates 12 and similar.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alterations could be made hereto without departing from the spirit and scope of the invention.

An antenna apparatus and radio terminal apparatus with reduced space or reduced size can be provided. Further, an antenna apparatus and radio terminal apparatus such that predetermined characteristics are obtained can be provided.

What is claimed is:

1. An antenna apparatus, comprising:

a rectangular substrate including a first edge length which extends between a first end and a second end of the substrate, and a second edge length, which is orthogonal to the first edge length;

a ground pattern provided on an area except a portion of the substrate;

first and second antenna elements which transmit and receive radio signals, and are provided on the portion of the substrate and apart from each other; and a wiring pattern provided between the first and second antenna elements on the portion of the substrate, wherein both ends of the wiring pattern are connected to a part of the ground pattern so that a loop path is formed by the wiring pattern and the part of the ground pattern, and an electrical length of the loop path is one wavelength of the radio signal, and the loop path is a path from a contact point of the ground pattern and wiring pattern to the contact point via the wiring pattern and the ground pattern.

2. The antenna apparatus according to claim 1, wherein a part of the wiring pattern is a meander line.

3. The antenna apparatus according to claim 1, wherein the first and second antenna elements are provided on a first face of the substrate, and the ground pattern and the wiring pattern are provided on a second face of the substrate.

4. The antenna apparatus according to claim 1, wherein the wiring pattern includes a lumped constant element.

5. The antenna apparatus according to claim 2, wherein the meander line comprises a plurality of long edge lines and short edge lines connecting the long edge lines, and the long edge lines have length set as being shorter in accordance with distances from the first and second antenna elements.

6. The antenna apparatus according to claim 1, wherein each of the first and second antenna elements includes a first unit and a second unit which is bent from the first unit into an L shape, the first unit is fixed on the portion of the substrate, and one end of the first unit is connected with a feed position, and the second unit is rotatably connected to the other end of the first unit, and wherein the first and second antenna elements are accommodated within the width of the second edge length.

7. The antenna apparatus according to claim 1, wherein the wiring pattern is a conductive metal flat plate.

8. The antenna apparatus according to claim 1, wherein the wiring pattern is a stub.

9. The antenna apparatus according to claim 1, wherein the ground pattern is a conductive metal flat plate.

10. The antenna apparatus according to claim 1, wherein the ground pattern includes a slit at a portion corresponding to a space between the first unit of the antenna element and the stab.

11. A radio terminal apparatus for transmitting or receiving radio signal, the radio terminal apparatus comprising:

a housing; and an antenna apparatus accommodated in the housing, wherein the antenna apparatus includes:

a rectangular substrate including a first length which extends between a first end and a second end of the substrate, and a second length, which is orthogonal to the first length;

a ground pattern provided on an area except a portion of the substrate;

first and second antenna elements which transmit and receive radio signals, and are provided on the portion of the substrate and apart from each other; and a wiring pattern provided between the first and second antenna elements on the portion of the substrate, both ends of the wiring pattern are connected to a part of the ground pattern so that a loop path is formed by the wiring pattern and the part of the ground pattern, an electrical length of the loop path is one wavelength of the radio signal, and the loop path is a path from a contact point of the ground pattern and wiring pattern to the contact point via the wiring pattern and ground pattern.

* * * * *